US005359978A

United States Patent [19]

Kidokoro et al.

[11] Patent Number: 5,359,978

[45] Date of Patent: Nov. 1, 1994

[54] APPARATUS FOR CONTROLLING AN INTERNAL PRESSURE OF A FUEL TANK IN AN EVAPORATED FUEL PURGE SYSTEM

[75] Inventors: Toru Kidokoro; Takaaki Ito; Yoshihiko Hyodo; Akinori Osanai, all of Susono, Japan

[73] Assignee: Toyota Jidosha Kabushiki Kaisha, Aich, Japan

[21] Appl. No.: 90,395

[22] Filed: Jul. 12, 1993

[30] Foreign Application Priority Data

| | | | |
|---|---|---|---|
| Jul. 13, 1992 | [JP] | Japan | 4-185174 |
| Jul. 15, 1992 | [JP] | Japan | 4-188394 |
| Aug. 28, 1992 | [JP] | Japan | 4-229707 |

[51] Int. Cl.[5] ..... F02M 33/02

[52] U.S. Cl. ..... 123/520; 123/516

[58] Field of Search ..... 123/520, 518, 519, 521, 123/198 D

[56] References Cited

U.S. PATENT DOCUMENTS

| | | | |
|---|---|---|---|
| 927,895 | 8/1992 | Kidokoro et al. . | |
| 4,044,743 | 8/1977 | Eaton | 124/520 |
| 4,153,025 | 5/1979 | Thornburgh | 123/520 |
| 4,343,281 | 8/1982 | Oozumi | 123/520 |
| 4,702,216 | 10/1987 | Haruta | 123/520 |
| 5,123,459 | 6/1992 | Toshihiro | 123/520 |
| 5,211,151 | 5/1993 | Nakajima et al. | 123/516 |
| 5,220,898 | 6/1993 | Kidokoro | 123/519 |
| 5,235,955 | 8/1992 | Osaki | 123/520 |
| 5,267,547 | 12/1993 | Chikamatsu | 123/518 |

FOREIGN PATENT DOCUMENTS

| | | |
|---|---|---|
| 51-105906 | 3/1976 | Japan . |
| 55-28736 | 2/1980 | Japan . |
| 130254 | 4/1990 | Japan . |

*Primary Examiner*—Carl S. Miller

*Attorney, Agent, or Firm*—Kenyon & Kenyon

[57] ABSTRACT

A fuel pressure control apparatus includes a valve for controlling an internal pressure of a fuel tank, the valve including a valving member, a valve seat, and an actuating member for pressing the valving member on the valve seat under a set pressure; and a pressure adjusting part for adjusting the set pressure of the actuating member of the valve to a first set pressure when an engine is operating, the first set pressure being higher than an atmospheric pressure and allowing the internal pressure of the fuel tank to be in equilibrium with the first set pressure, and for adjusting the set pressure of the actuating member to a second set pressure when the engine stops operating, the second set pressure being higher than the first set pressure, thus allowing the internal pressure of the fuel tank to be increased, when the engine stops operating, to a pressure higher than the first set pressure.

14 Claims, 15 Drawing Sheets

INTERNAL COMBUSTION ENGINE
10
15
PRESSURE ADJUSTING PART
14
13 PRESSURE CONTROL VALVE
13c
ACTUATING MEMBER
13b
VALING MEMBER
13a
VALVE SEAT
FUEL TANK
11
CANISTER
12

APPARATUS FOR CONTROLLING AN INTERNAL PRESSURE OF A FUEL TANK IN AN EVAPORATED FUEL PURGE SYSTEM

BACKGROUND OF THE INVENTION (1) Field of the Invention

The present invention generally relates to a fuel tank pressure control apparatus, and more particularly to an apparatus for controlling an internal pressure of a fuel tank in an evaporated fuel purge system when an engine is operating and when the engine operation is stopped.

(2) Description of the Related Art

In an internal combustion engine of an automotive vehicle, an evaporated fuel purge system is provided. In the evaporated fuel purge system, fuel vapor evaporated in a fuel tank is supplied to a canister so that the fuel vapor is absorbed by an absorbent in the canister. The fuel vapor in the canister is fed into an intake passage of the engine through a purge passage when the engine is operating under prescribed operating conditions.

In the evaporated fuel purge system, if a large amount of fuel vapor is supplied to the canister via a vapor passage, or if the amount of the supplied fuel is greater than the permissible amount of fuel that the canister can store (or the canister capacity), the canister may overflow with the fuel supplied, and the excessive fuel may escape from an opening of the canister into the atmosphere.

In order to eliminate the above described problem, it is necessary to regulate the amount of fuel vapor evaporated in the fuel tank at a reasonable level. For this purpose, in a conventional evaporated fuel purge system, means for setting the internal pressure of the fuel tank to a relatively high pressure is provided.

When the engine has just stopped operating, the fuel in a sub-tank of the fuel tank is still at a relatively high temperature. The fuel in a main tank of the fuel tank is subjected to the heat of the fuel in the sub-tank and to the heat of an exhaust system surrounding the fuel tank. Thus, the fuel temperature is temporarily increased after the engine has stopped operating, and an increased amount of fuel vapor is produced in the fuel tank. Such fuel vapor is supplied from the fuel tank to the canister.

However, no fuel vapor from the canister is supplied to the intake passage of the engine after the engine has stopped operating. Accordingly, there is a problem in that the increased amount of fuel vapor produced in the fuel tank after the engine has stopped operating is supplied to the canister. Thus the canister may overflow.

Japanese Laid-Open Utility Model Publication No. 51-105906 discloses a pressure control valve arranged in a passage between a fuel tank and a canister. The control valve is closed when the engine stops operating, so as to increase the internal pressure of the fuel tank preventing a large amount of fuel vapor from being produced when the engine stops operating. The control valve has a bypass passage which is open to the fuel tank when the engine is operating, allowing the internal space of the fuel tank to communicate with the canister via the bypass passage.

However, in the pressure control valve disclosed in the above mentioned publication, the fuel tank is open to the canister via the bypass passage when the engine is operating. Thus, it is difficult to prevent the fuel in the fuel tank from spilling to the canister via the pressure control valve when the vehicle is turning around.

Also, in the pressure control valve disclosed in the above mentioned publication, a cut-off valve for preventing the fuel tank from being replenished with an excessive amount of fuel is provided. However, the cut-off valve is inoperative if the fuel supply is gradually increased, and it is difficult to prevent the fuel tank from being filled with excessive amount of fuel.

SUMMARY OF THE INVENTION

Accordingly, it is a general object of the present invention to provide a novel and useful fuel pressure control apparatus in which the above described problems are eliminated.

Another, more specific object of the present invention is to provide a fuel pressure control apparatus using a single pressure control valve of simple structure which can adjust an internal pressure of a fuel tank to be a first pressure higher than the atmospheric pressure when the engine is operating, and can adjust the internal pressure of the fuel tank to be a pressure higher than the first pressure when the engine stops operating.

The above mentioned objects of the present invention are achieved by a fuel pressure control apparatus for controlling an internal pressure of a fuel tank in an evaporated fuel purge system, the evaporated fuel purge system including the fuel tank containing fuel, a canister for storing fuel vapor supplied from the fuel tank, a purge control valve arranged in a purge passage between the canister and an intake passage of an engine, and a control part for opening the purge control valve when the engine is operating under prescribed operating conditions so that fuel vapor stored in the canister is fed into the intake passage through the purge passage due to a negative pressure of the intake passage, which apparatus includes: a pressure control valve for controlling the internal pressure of the fuel tank, the pressure control valve including a valving member, a valve seat, and an actuating member for pressing the valving member on the valve seat with a set pressure such that the internal pressure of the fuel tank is in equilibrium with the set pressure; and a pressure adjusting part for adjusting the set pressure of the actuating member of the pressure control valve to a first set pressure when the engine is operating, the first set pressure being higher than an atmospheric pressure and thus allowing the internal pressure of the fuel tank to be in equilibrium with the first set pressure, and for adjusting the set pressure of the actuating member to a second set pressure when the engine stops operating, the second set pressure being higher than the first set pressure, allowing the internal pressure of the fuel tank to be increased, when the engine stops operating, to a pressure higher than the first set pressure.

According to the present invention, when the engine is operating, the internal pressure of the fuel tank is adjusted by the pressure adjusting part to be in equilibrium with a relatively-low, first pressure which is higher than the atmospheric pressure. Thus, it is possible to prevent the fuel in the fuel tank from spilling to the canister when the vehicle is turning around. It is also possible to prevent the fuel tank from being erroneously replenished with an excessive amount of fuel. According to the present invention, when the engine stops operating, the internal pressure of the fuel tank is increased and adjusted by the pressure adjusting part to be in equilibrium with a relatively-high, second pressure which is higher than the first pressure set during the engine operation. Thus, it is possible to reduce the amount of fuel vapor fed into the canister to a reasonable level even when the fuel temperature is high after the engine has just stopped operating.

Other objects and further features of the present invention will be apparent from the following detailed description when read in conjunction with the accompanying drawings.

BRIEF DESCRIPTION OF THE DRAWINGS

FIGS. 13A through 13 are timing charts for explaining the operation of the fuel pressure control apparatus shown in FIG. 10.

DESCRIPTION OF THE PREFERRED EMBODIMENTS

A description will now be given of a first embodiment of a fuel pressure control apparatus according to the present invention, with reference to FIG. 1.

Figure 1:
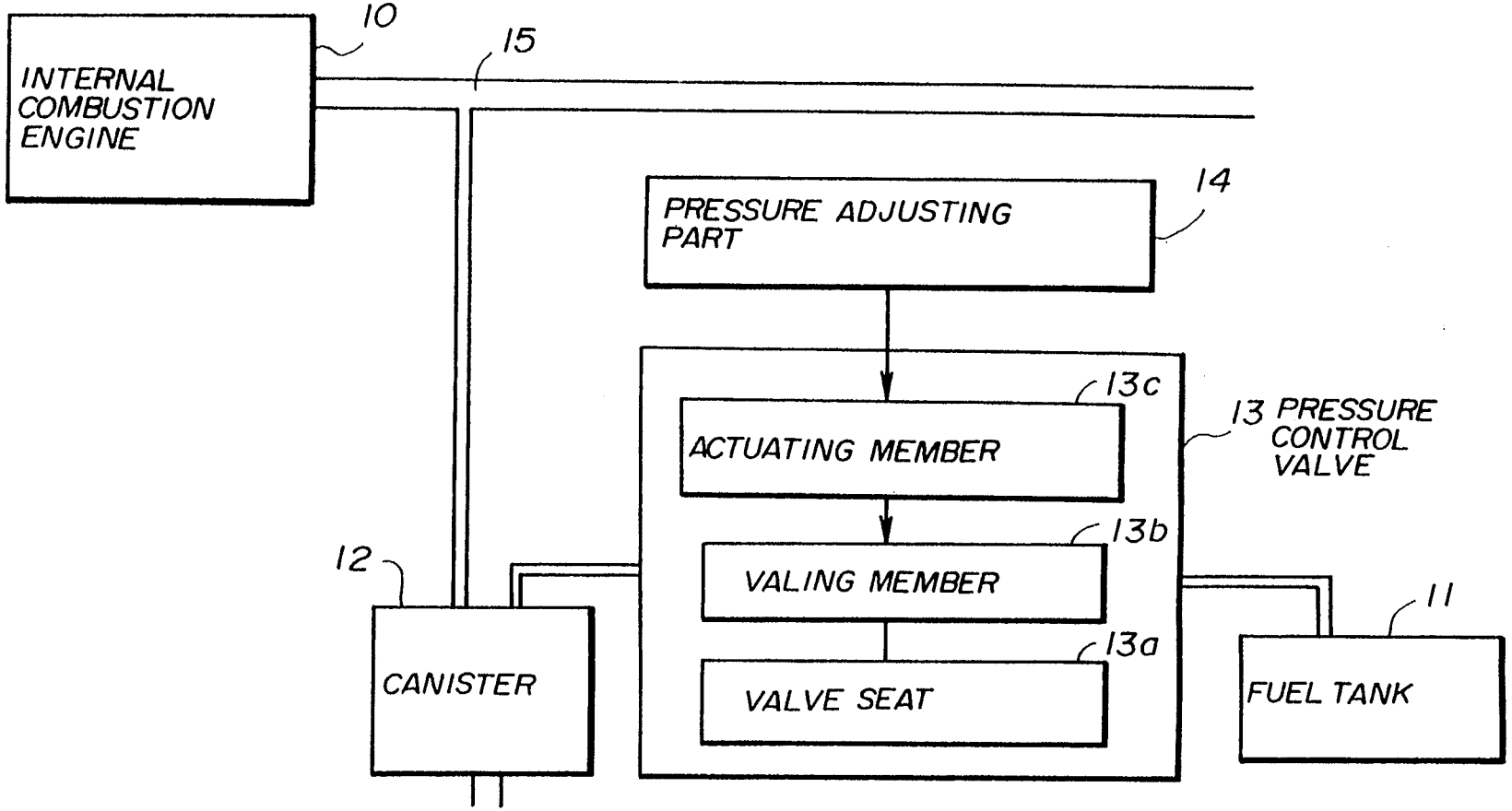
FIG. 1 is a block diagram showing a first embodiment of a fuel pressure control apparatus according to the present invention.

FIG. 1 shows the first embodiment of the fuel pressure control apparatus which is applied to an evaporated fuel purge system. In the evaporated fuel purge system, fuel vapor evaporated in a fuel tank 11 is supplied to a canister 12 through a vapor passage, so that the fuel vapor is absorbed by an absorbent in the canister 12. The fuel vapor stored in the canister is fed into an intake passage 15 of an internal combustion engine 10 through a purge passage when the engine 10 is operating under prescribed operating conditions.

The fuel pressure control apparatus shown in FIG. 1 comprises a pressure control valve 13 and a pressure adjusting part 14. The pressure control valve 13 is provided at an intermediate portion of a vapor passage between the fuel tank 11 and the canister 12 so as to control the internal pressure of the fuel tank 11. The pressure control valve 13 includes at least a valve seat 13*a*, a valving member 13*b*, and an actuating member 13*c*. The actuating member 13*c* presses the valving member 13*b* on the valve seat 13*a* under a set pressure.

The pressure adjusting part 14 shown in FIG. 1 is provided within the evaporated fuel purge system. The pressure adjusting part 14 adjusts the set pressure of the actuating member 13*c* of the pressure control valve 13 to a first set pressure when the engine 10 is operating. The first set pressure thus adjusted by the pressure adjusting part 14 allows the internal pressure of the fuel tank 11 to be higher than the atmospheric pressure when the engine is operating. When the engine 10 stops operating, the pressure adjusting part 14 adjusts the set pressure of the actuating member 13*c* to a second set pressure. The second set pressure thus adjusted by the pressure adjusting part 14 allows the internal pressure of the fuel tank 11 to be increased to be higher than the first set pressure when the engine stops operating.

Figure 2B:
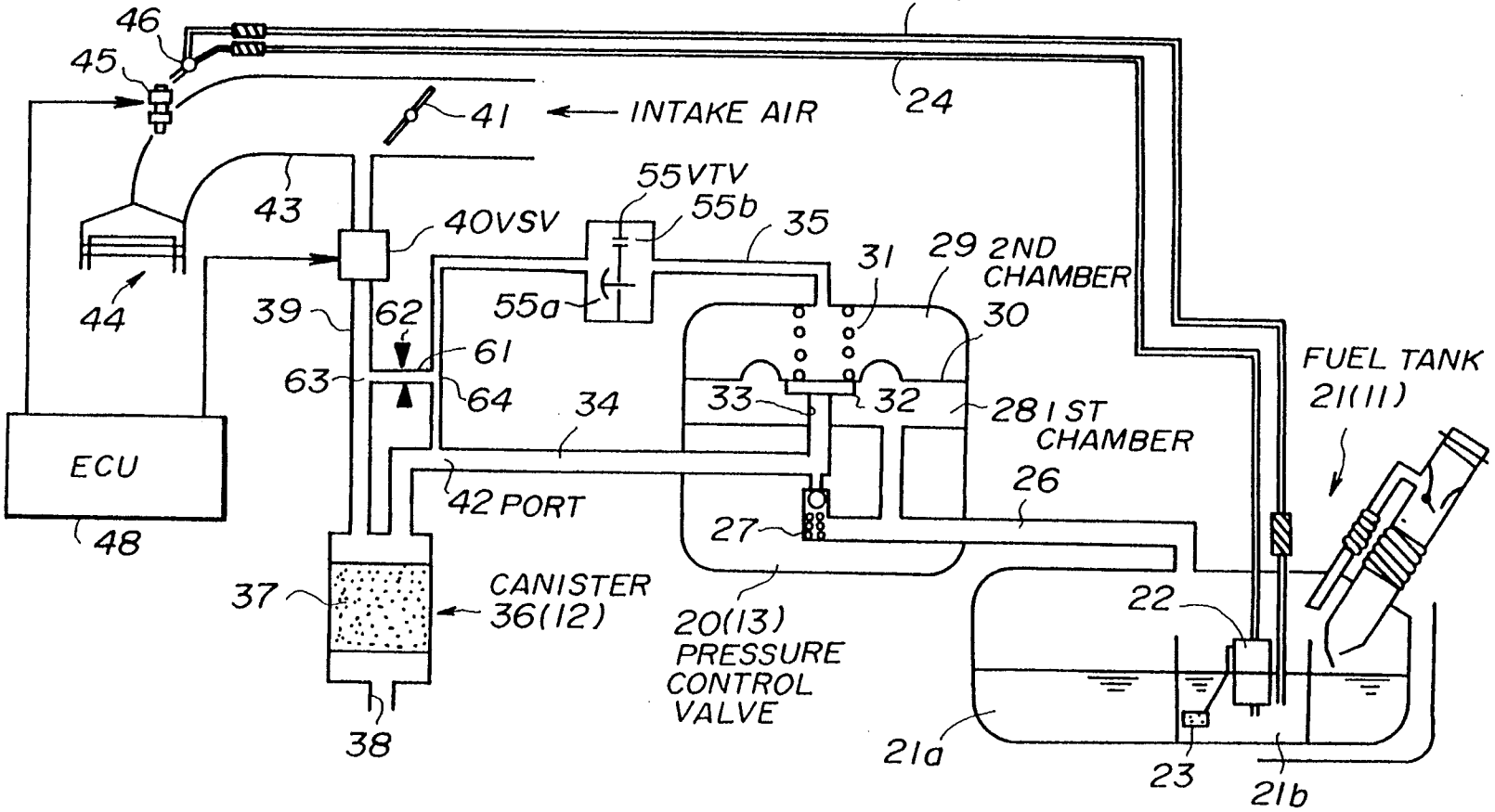
FIG. 2B is a view showing a modification of the evaporated fuel purge system, shown in FIG. 2A, to which the first embodiment is applied.
Figure 2A:
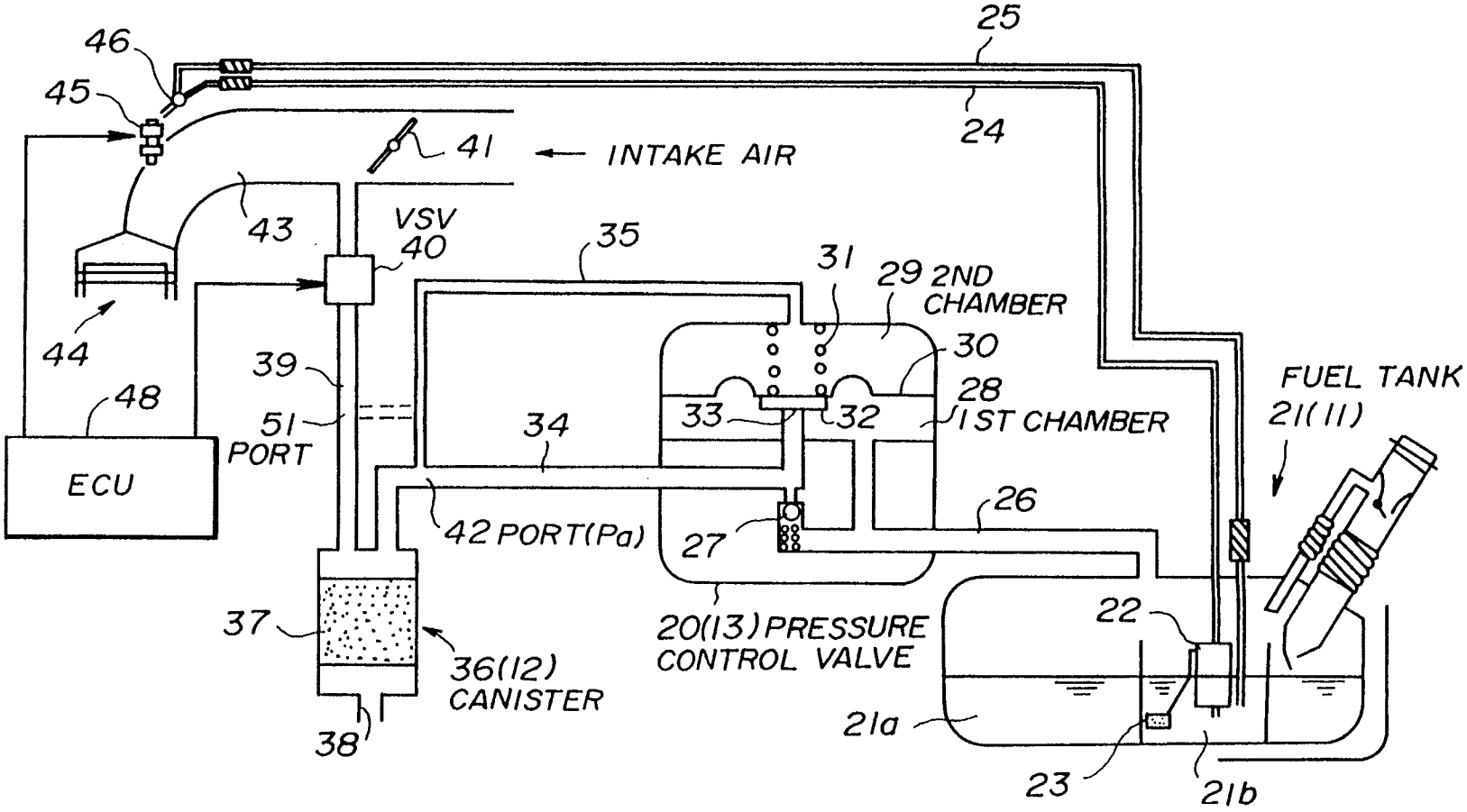
FIG. 2A is a view showing an evaporated fuel purge system to which the first embodiment of the fuel pressure control apparatus shown in FIG. 1 is applied.

FIG. 2A shows an evaporated fuel purge system to which the first embodiment is applied. In FIG. 2A, a fuel tank 21 is made up of a main tank 21*a* and a sub-tank 21*b*. In the sub-tank 21*b*, a fuel pump 22 and a fuel gage 23 are arranged. A fuel pipe 24 is connected at one end to the fuel pump 22 and is connected at the other end to an engine 44, and the fuel pump 22 supplies fuel from the sub-tank 21*b* to the engine 44 via the fuel pipe 24. A fuel return pipe 25 is connected at one end to the sub-tank 21*b* and connected at the other end to the engine 44, and fuel is returned from the engine 44 back to the sub-tank 21*b* via the fuel return pipe 25.

The fuel tank 23 communicates with a pressure control valve 20 via a first vapor passage 26. The pressure control valve 20 serves to control the internal pressure of the fuel tank 21. The internal space of the pressure control valve 20 is divided by a diaphragm 30 into a first chamber 28 and a second chamber 29. The fuel tank 21 communicates with the first chamber 28 of the pressure control valve 20 via the first vapor passage 26, and the first vapor passage 26 is connected to a check valve 27.

In the pressure control valve 20, a spring 31 is provided in the second chamber 29, and the diaphragm 30 is downwardly pressed by the spring 31. At the center of the diaphragm 30, a vapor inlet opening 33 is formed as the valve seat, and a valving member 32 is provided on the valve seat to close the vapor inlet opening 33. When the engine 44 stops operating, the vapor inlet opening 33 is closed by the valving member 32 of the diaphragm 30 downwardly pressed by the spring 31. The vapor inlet opening 33 communicates with a canister 36 via a second vapor passage 34. The canister 36 contains active carbon 37 for absorbing fuel vapor supplied from the fuel tank 21.

The pressure control valve 20 controls the pressure of fuel vapor in the first chamber 28 by means of the spring 31 and the diaphragm 30 under a set pressure. When the internal pressure of the fuel tank 21 is lowered to a negative pressure lower than the atmospheric pressure, the check valve 27 is opened (which is lowered against the upward force of the spring at the check valve 27) to subject the canister 36 to the negative pressure of the fuel tank 21. Fuel vapor is desorbed from the active carbon 37 of the canister 36, and the desorbed fuel is returned from the canister 36 to the fuel tank 21 via the second vapor passage 34 and the first vapor passage 26.

The second chamber 29 of the pressure control valve 20 communicates with the canister 36 via a negative pressure passage 35. The negative pressure passage 35 is provided to connect the second chamber 29 of the pressure control valve 20 to a port 42 at an interconnecting point between the second vapor passage 42 and the negative pressure passage 35.

The canister 36 is provided at its bottom portion with an air inlet opening 38 leading to the atmosphere. The canister 36 communicates with an intake passage 43 of the engine 44 via a purge passage 39. At an intermediate portion of the purge passage 39, a vacuum switching valve (VSV) 40 is provided to control the flow of fuel vapor into the intake passage 43. The intake passage 43 communicates with a combustion chamber of the engine 44. A fuel injector 45 provided at a portion of the intake passage 43 adjacent to the combustion chamber is connected in turn to the end of the fuel pipe 24. The fuel injector 45 at its outlet injects fuel supplied from the fuel pump 22, into the combustion chamber. The air-fuel mixture is supplied to the combustion chamber of the engine 44.

A throttle valve 41 is provided in the intake passage 43 to control the flow of intake air fed from the intake passage 43 into the engine 44. External air enters the intake passage 43 in a direction indicated by the arrow in FIG. 2A. The position at which the purge passage 39 is connected to the intake passage 43 is located adjacent to and downstream of the throttle valve 41 in the intake passage 43.

A pressure regulator 46 is provided in the fuel pipe 24 at a location adjacent to the fuel injector 45 so as to adjust the pressure of fuel injected by the fuel injector 45 at a prescribed pressure level. An electronic control unit (ECU) 48 which is made up of a microcomputer is provided to control the fuel injection timing of the fuel injector 45 as well as the valve opening/closing timing of the VSV 40 in accordance with engine operating conditions.

Next, a description will be given of the operation of the evaporated fuel purge system shown in FIG. 2A. When an ignition switch (IG) is turned ON (at a time point t1 indicated in FIG. 3C), the fuel pump 22 starts operating to discharge fuel from the sub-tank **21*b* of the fuel tank 21. The fuel discharged by the fuel pump 22 is fed into the pressure regulator 46 via the fuel pipe 24, so that the fuel the pressure of which is adjusted at the given pressure level by the pressure regulator 46 is supplied to the fuel injector 45. The remainder of the fuel supplied to the fuel injector 45 is returned from the pressure regulator 46 to the fuel tank 21 via the fuel return pipe 25**.

Fuel vapor evaporated in the fuel tank 21 is supplied to the pressure control valve 20 via the first vapor passage 26. When the engine stops operating, no fuel vapor is fed from the canister 36 to the intake passage 43 through the VSV 40, the pressure Pc of the port 42 is approximately equal to the atmospheric pressure through the air inlet opening 38 of the canister 36. The negative pressure passage 35 at this time is still not subjected to a negative pressure. The pressure of the first chamber 28 (which pressure is equal to the fuel tank pressure Pt) is in equilibrium with a given pressure value P (which is positive or above the atmospheric pressure). This pressure value P is set by the mechanical properties of the diaphragm 30 and the spring 31.

When the fuel tank pressure Pt (which is equal to the pressure of the first chamber 28 of the valve 20) is increased to a pressure higher than the pressure value P, the valving member 32 is raised due to the increased pressure Pt against the downward force of the diaphragm 30 and the spring 31, so that the vapor inlet opening 33 is opened to make the first chamber 28 communicate with the canister 36. Fuel vapor supplied from the fuel tank 21 is fed from the vapor inlet opening 33 of the pressure control valve 20 into the canister 36 via the second vapor passage 34. The fuel vapor is absorbed in the active carbon 37 of the canister 36.

The fuel vapor stored in the canister 36 is fed into the intake passage 43 when the VSV 40 in the purge passage 39 is opened or switched ON. The feeding of fuel vapor mentioned above is called a purging or purge execution. The VSV 40 is switched ON by the ECU 48 when a set of purge execution conditions is satisfied. The purge execution conditions include: (1) the temperature of engine cooling water is higher than a given temperature; (2) the feedback control process for setting a fuel injection time so as to obtain a target air-fuel ratio is being performed; (3) the intake air amount is greater than a prescribed air amount; and (4) the fuel cutting process is not being performed. The ECU 48 detects whether or not all the purge execution conditions mentioned above are satisfied. If it is detected that all the purge execution conditions are satisfied, the VSV 40 is switched ON and the fuel vapor in the canister is fed into the intake passage 43 via the VSV 40. The feeding of fuel vapor into the engine is carried out under the above purge execution conditions, and it is possible to minimize any harmful influences on the driveability and the exhaust emission even if the air-fuel ratio deviates from the target air-fuel ratio.

Figures 3A, 3B, 3C:
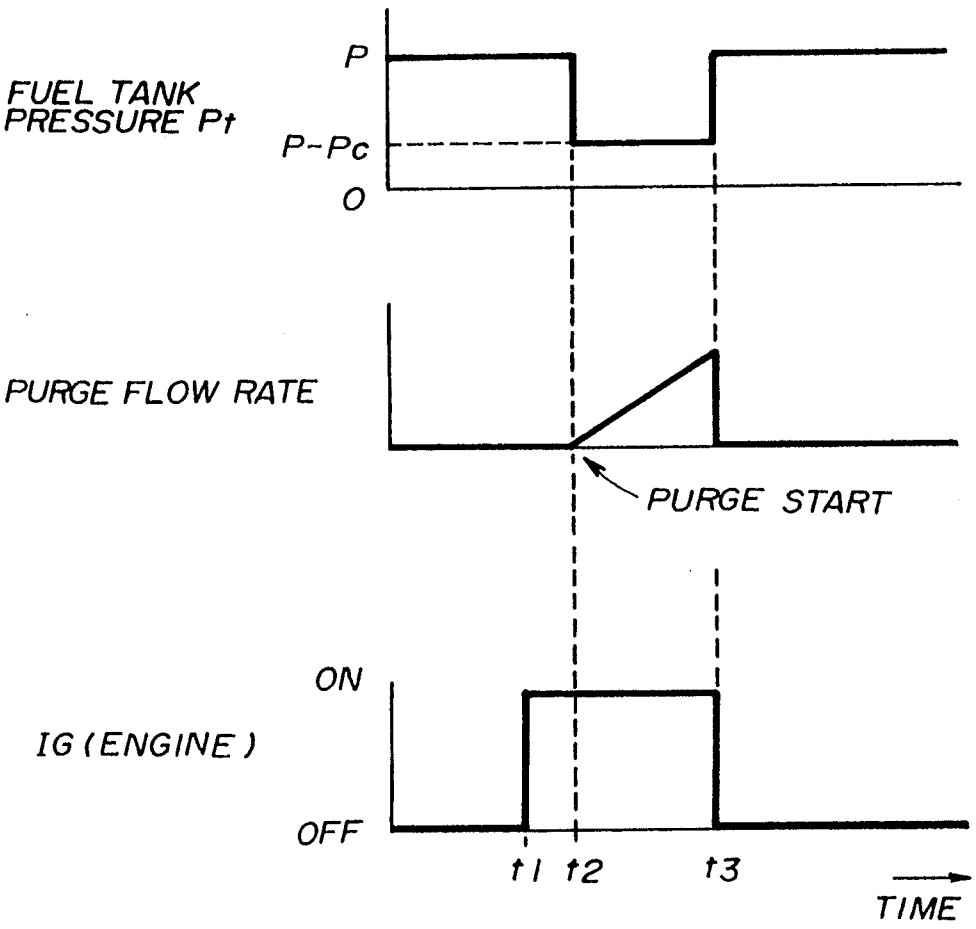
FIGS. 3A through 3C are timing charts for explaining the operation of the fuel pressure control apparatus shown in FIG. 2A.

If it is detected by the ECU 48 at a time point t2 indicated in FIG. 3B that all the purge execution conditions are satisfied, the VSV 40 is switched ON so that the fuel vapor is fed from the canister 36 into the intake passage 43. Due to a negative pressure in the intake passage 43, external air enters the canister 36 from the air inlet opening 38, and the fuel vapor is desorbed from the active carbon 37 of the canister 36. Thus, the fuel vapor in the canister 36 is fed into the intake passage 43 when the VSV 40 is opened. The active carbon 37 is re-activated after the desorption of the fuel vapor, and it is waiting to absorb fuel vapor subsequently supplied from the fuel tank 21.

FIG. 3B indicates that the flow rate of fuel vapor fed into the intake passage 43 is gradually increasing from the time point t2.

When the engine 44 is operating under prescribed operating conditions, the VSV 40 is opened and the port 42 is subjected to a negative pressure of the intake passage 43. The second chamber 29 of the pressure control valve 20 is subjected to the negative pressure Pc of the port 42 through the negative pressure passage 35. As a result, the pressure of the first chamber 28 (or, the fuel tank pressure Pt) is lowered and is in equilibrium with a second pressure lower than the pressure value P set by the diaphragm 30 and the spring 31. FIG. 3A indicates that the fuel tank pressure Pt between the time points t2 and t3 (during the purge execution) is lowered to and maintained at the second pressure indicated as (P−Pc). Because the pressure value P set by the diaphragm 30 and the spring 31 is greater than the absolute value of the negative pressure Pc, the difference (P−Pc) between the two values is positive or greater than zero.

When the ignition switch IG is turned OFF at the time point t3 as indicated in FIG. 3C, the engine 44 stops operating, and the VSV 40 is switched OFF. The purge passage 39 is closed by the VSV 40, and the port 42 at the end of the negative pressure passage 35 is subjected to the atmospheric pressure. The second chamber 29 of the pressure control valve 20 is also subjected to the atmospheric pressure through the negative pressure passage 35. The fuel tank pressure Pt is increased and is in equilibrium with the pressure value P (set by the diaphragm 30 and the spring 31) at the time point t3 as shown in FIG. 3A.

In the evaporated fuel purge system shown in FIG. 2A, the negative pressure passage 35 connects the pressure control valve 20 and the second vapor passage 34 so as to subject the second chamber 29 to the negative pressure Pc of the port 42. However, the level of negative pressure produced in the purge passage 39 varies depending on the configurations of the engine 44, the canister 36, and the purge passage piping. The configurations of the engine, the canister, and the piping mounted on vehicles of different types are different. In an evaporated fuel purge system mounted on a vehicle of some type, it is difficult to obtain a sufficient level of negative pressure from the port 42 in the second vapor passage 34. In such a system, a port 51 is provided at an intermediate portion of the purge passage 39 instead of the port 42 shown in FIG. 2A, and the negative pressure passage 35 is formed to connect the port 51 to the pressure control valve 20. It is possible for the evaporated fuel purge system to obtain a sufficient level of negative pressure from the port 51 in the purge passage 39.

FIG. 2B shows a modification to the evaporated fuel purge system shown in FIG. 2A. In the modified system shown in FIG. 2B, a vacuum transmitting valve (VTV) 55 is provided at an intermediate portion of the negative pressure passage 35, a bypass pipe 61 is provided between the purge passage 39 and the negative pressure passage 35, and an orifice 62 is provided in the bypass pipe 61. As shown in FIG. 2B, the interconnecting point between the second vapor passage 34 and the negative pressure passage 35 is the port 42, an interconnecting point between the purge passage 39 and the bypass pipe 61 is a port 63, and an interconnecting point between the negative pressure passage 35 and the bypass pipe 61 is a port 64.

The VTV 55 shown in FIG. 2B is made up of a check valve **55*a* and an orifice 55*b*. When the negative pressure of the port 42 is lower than the pressure of the second chamber 29, both the check valve 55*a* and the orifice 55*b* are opened and the second chamber 29 of the pressure control valve 20 is subjected to the negative pressure of the port 42 through the VTV 55. When the pressure of the port 42 is higher than the pressure of the second chamber 29, the check valve 55*a* is closed. The second chamber 29 of the valve 20 communicates with the port 42 through the orifice 55*b* only so as to prevent the internal pressure of the second chamber 29** from being increased to the atmospheric pressure.

In the evaporated fuel purge system shown in FIG. 2B, the second chamber 29 is subjected to a pressure equal to the average of the negative pressure of the port 42 and the negative pressure of the port 63. The orifice 62 in the bypass pipe 61 is formed to have an inside diameter suitable to obtain an appropriate level of the negative pressure. The inside diameter of the orifice **55*b*** is formed so as to suit the practical use.

In the first embodiment described above, the internal pressure of the fuel tank is controlled by the pressure control valve 20 to be in equilibrium with a suitable set pressure higher than the atmospheric pressure. By the construction of the pressure control valve 20 described above, it is possible to prevent the fuel in the fuel tank from spilling to the canister when the vehicle is turning around, and it is also possible to prevent the fuel tank from being replenished with an excessive amount of fuel.

In the first embodiment described above, when the engine stops operating, the internal pressure of the fuel tank is adjusted by the pressure control valve 20 to be in equilibrium with the second pressure which is relatively high and is higher than the first pressure being set during the engine operation. Thus, it is possible to reduce the amount of fuel vapor fed into the canister to a reasonable level even when the fuel temperature is high after the engine has just stopped operating. Accordingly, the two-stage adjustment of the fuel tank pressure when the engine is operating and when the engine stops operating can be achieved by using only one pressure control valve of a simple structure.

Figure 4:
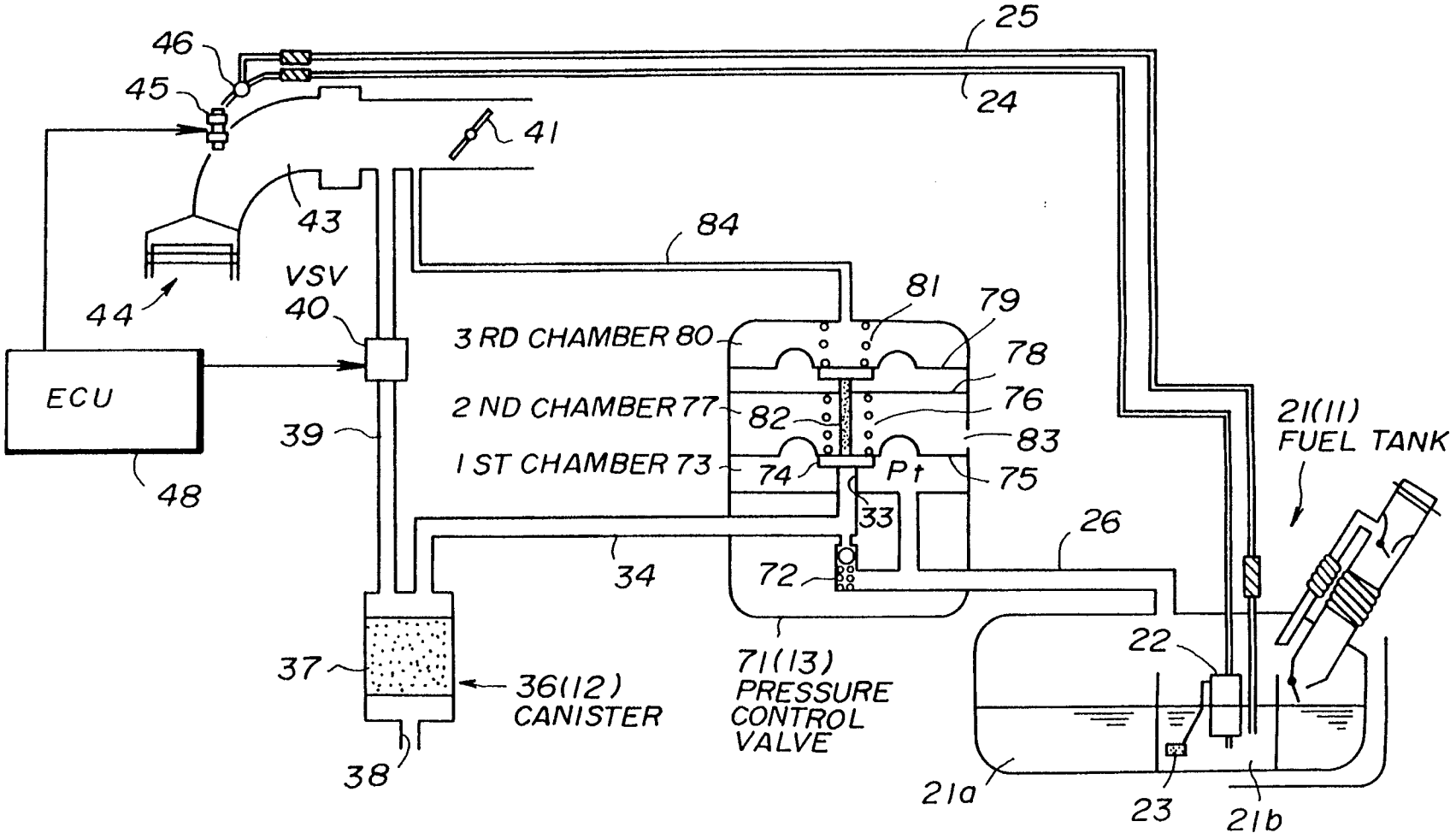
FIG. 4 is a view showing an evaporated fuel purge system to which a second embodiment of the fuel pressure control apparatus is applied, the apparatus being in an operating condition when the engine stops operating.
Figure 5:
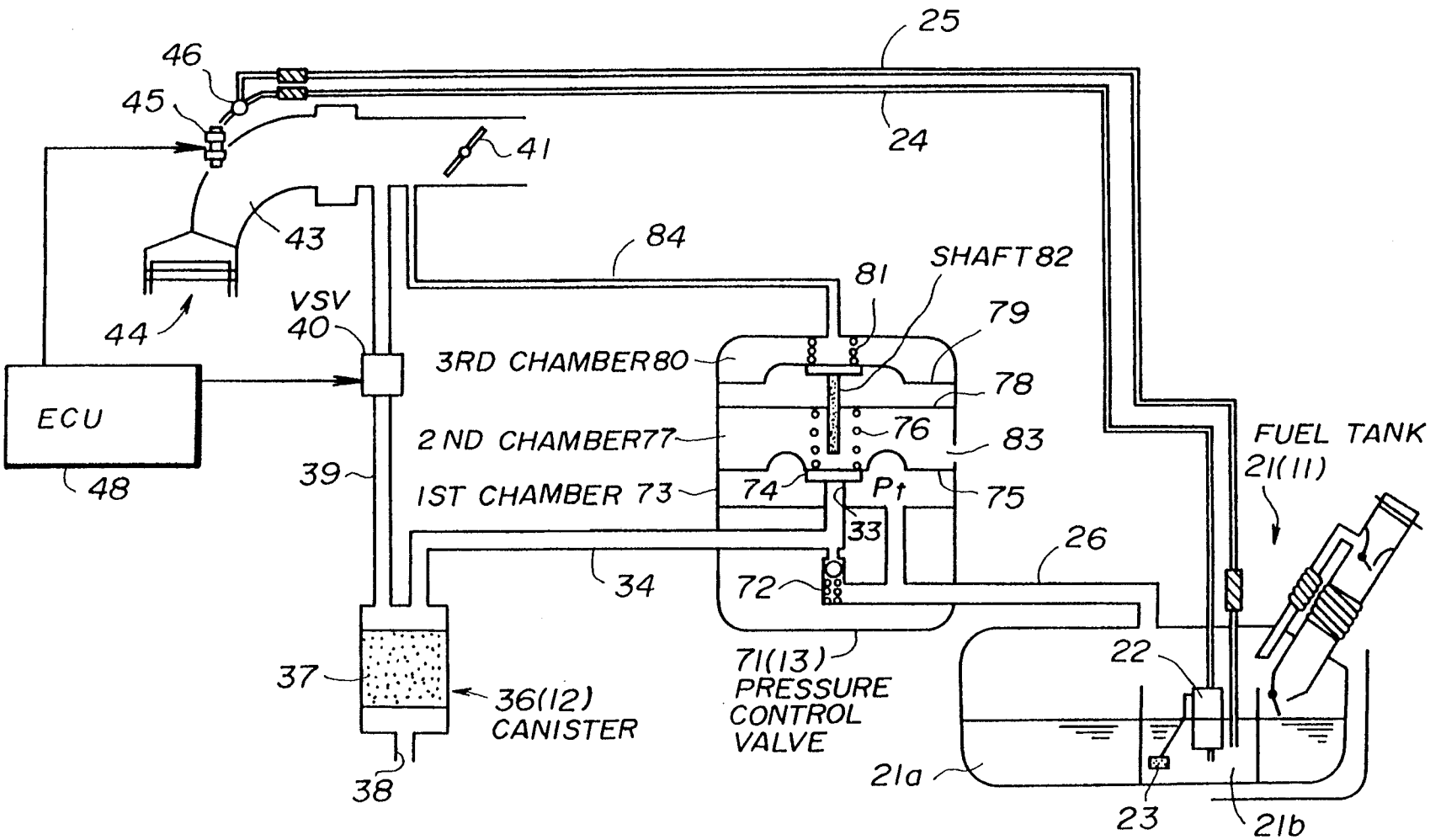
FIG. 5 is a diagram showing an operating condition of the fuel pressure control apparatus shown in FIG. 4 when the engine is operating.

Next, a description will be given of a second embodiment of the fuel pressure control apparatus according to the present invention. FIGS. 4 and 5 show an evaporated fuel purge system to which the second embodiment of the fuel pressure control apparatus is applied. More specifically, FIG. 4 shows a condition of the evaporated fuel purge system when the engine stops operating, and FIG. 5 shows a condition of the evaporated fuel purge system when the engine is operating. In FIGS. 4 and 5, the parts which are the same as the corresponding parts shown in FIG. 2 are designated by the same reference numerals, and a description thereof will be omitted.

In the fuel pressure control apparatus shown in FIGS. 4 and 5, a pressure control valve 71 is provided between the fuel tank 21 and the canister 36. This pressure control valve 71 serves to control the internal pressure of the fuel tank 21. The internal space of the pressure control valve 71 is divided by two different diaphragms 75 and 79 into a first chamber 73, a second chamber 77, and a third chamber 80. The first chamber 73 and the second chamber 77 are separated from each other by the diaphragm 75, and the second chamber 77 and the third chamber 80 are separated from each other by the diaphragm 79.

The first chamber 73 of the pressure control valve 71 communicates with the fuel tank 21 via the first vapor passage 26. The pressure control valve 71 includes a check valve 72 at a portion where the first vapor passage 26 and the second vapor passage 34 join together. If the internal space of the fuel tank 21 is at a negative pressure, the check valve 72 is opened (a valving member of the check valve 72 is lowered against the upward force of a spring thereof) so as to subject the canister to the negative pressure of the fuel tank 21. Fuel vapor is desorbed from the active carbon 37 of the canister 36 due to the negative pressure, and the fuel vapor is returned back to the fuel tank 21.

Within the first chamber 73 of the pressure control valve 71, the vapor inlet opening 33 is formed as a valve seat at the center of the diaphragm 75, and a valving member 74 fixed to the bottom surface of the center of the diaphragm 75 is mounted so as to close or open the vapor inlet opening 33. The valving member 74 is downwardly pressed on the vapor inlet opening 33 under a given first pressure P1 by the spring 76 and the diaphragm 75. This first pressure value P1 is set depending on the mechanical properties of the spring 76 and the diaphragm 75.

Within the second chamber 77 of the pressure control valve 71, a spring 76 is provided at the center of the diaphragm 75, one end of the spring 76 being fixed to a fixing member 78 (which is fixed to a side wall of the pressure control valve 71), and the other end of the spring 76 being fixed to the top surface of the diaphragm 75. In conjunction with the spring 76, a retaining shaft 82 is provided in the second chamber 77. The top portion of the retaining shaft 82 is fixed to the bottom surface of the diaphragm 79. As shown in FIG. 4, the bottom end portion of the retaining shaft 82 comes in contact with the top surface of the diaphragm 74 when the engine 44 stops operating.

Within the third chamber 80 of the pressure control valve 71, a spring 81 is provided at the center of the diaphragm 79. The top portion of the retaining shaft 82 which portion is fixed to the bottom surface of the diaphragm 79 is downwardly pressed under a given pressure P2 by the spring 81 and the diaphragm 79.

The first chamber 73 of the pressure control valve 71 is at a pressure equal to the fuel tank pressure Pt. Within the second chamber 77, an opening 83 leading to the atmosphere is formed in a side wall of the frame of the valve 71, and the second chamber 77 is at the atmospheric pressure. The third chamber 80 communicates with the intake passage 43 through a negative pressure passage 84, and the third chamber 80 is subjected to a negative pressure of the intake passage 43 when the engine 44 is operating. An interconnecting portion at which the negative pressure passage 84 is connected to the intake passage 43 is located downstream from the throttle valve 41.

Next, a description will be given, with reference to FIGS. 6A and 6B, of the operation of the evaporated fuel purge system shown in FIGS. 4 and 5 to which the second embodiment is applied. When the ignition switch IG is turned ON at a time point t11 indicated in FIG. 6B, the engine 44 starts operating. The third chamber 80 of the pressure control valve 71 is subjected to a negative pressure of the intake passage 43 through the negative pressure passage 84. The diaphragm 79 is raised against the downward force of the spring 81 due to the negative pressure of the third chamber 80. Together with the diaphragm 79, the retaining shaft 82 is upwardly moved, and the bottom end portion of the retaining shaft 82 is separate from the diaphragm 75 as shown in FIG. 5.

Figures 6A, 6B:
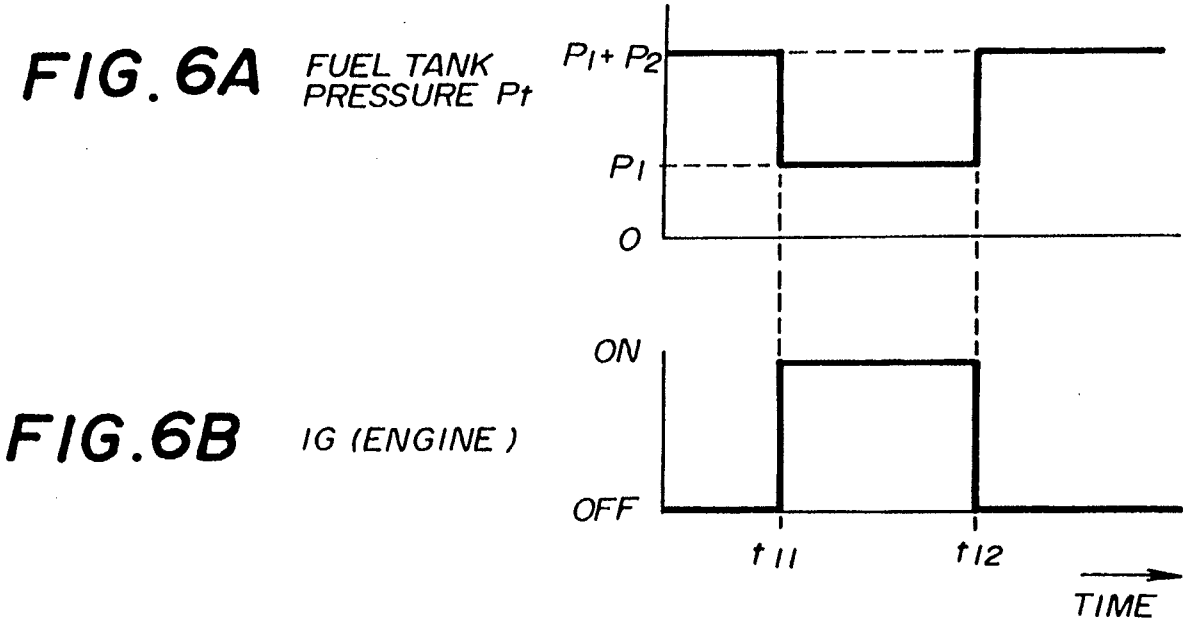
FIGS. 6A and 6B are timing charts for explaining the operation of the fuel pressure control apparatus shown in FIGS. 4 and 5.

Consequently, the fuel tank pressure Pt (or the pressure of the first chamber 73) is lowered and is in equilibrium with the first pressure P1 (set by the spring 76 and the diaphragm 75), as shown in FIG. 6A. Therefore, when the engine 44 is operating, the fuel tank pressure Pt is adjusted to be in equilibrium with the first pressure P1 (which is relatively low) by the pressure control valve 71. If the pressure of fuel vapor in the fuel tank 21 is higher than the first pressure P1 during the engine operation, the valving member 74 is raised against the downward force of the spring 76 and the diaphragm 75. The fuel vapor from the fuel tank 21 is thus supplied to the canister 36 through the second vapor passage 34, so that the supplied fuel vapor is absorbed by the active carbon 37 of the canister 36. When the VSV 40 is switched ON by the ECU 48 to open the purge passage 39, the fuel vapor stored in the canister 36 is fed into the intake passage 43 via the purge passage 39.

When the ignition switch IG is turned OFF at a time point t12 indicated in FIG. 6B, the engine 44 stops operating. The intake passage 43 is not subjected to a negative pressure when the engine 44 stops operating, and the pressure of the intake passage 43 is increased to the atmospheric pressure. The third chamber 80 of the pressure control valve 71 is at the atmospheric pressure through the negative pressure passage 84. The retaining shaft 82 is lowered due to the downward force of the diaphragm 79 and the spring 81, so that the bottom end portion of the retaining shaft 82 is brought in contact with the diaphragm 75 as shown in FIG. 4.

Consequently, at the time point t12 indicated in FIG. 6B, the fuel tank pressure Pt (or the pressure of the first chamber 73) is increased and then is in equilibrium with a second pressure. This second pressure is, as shown in FIG. 6A, equal to a given pressure value P2 (set by the spring 81 and the diaphragm 79) being added to the pressure value P1 (set by the spring 76 and the diaphragm 75). Therefore, when the engine has stopped operating, the fuel tank pressure Pt is immediately adjusted by the pressure control valve 71 to be in equilibrium with the second pressure (P1+P2). Because the second pressure (P1+P2) to which the internal space of the fuel tank 21 is subjected when the engine stops operating is higher than the first pressure P1 when the engine is operating, it is possible to reduce the amount of fuel vapor evaporated in the fuel tank 21 due to the increased fuel tank pressure. In the above second embodiment, a reduced amount of fuel vapor can be fed from the fuel tank 21 into the canister 36 through the pressure control valve 71.

In the second embodiment described above, the internal pressure of the fuel tank 21 is adjusted by the pressure control valve 71 to be in equilibrium with a suitable set pressure which is high than the atmospheric pressure.

In the second embodiment described above, when the engine stops operating, the internal pressure of the fuel tank 21 is immediately increased and adjusted by the pressure control valve 71 to be in equilibrium with the second pressure (P1+P2) which is relatively high and is higher than the first pressure. Thus, it is possible to reduce the amount of fuel vapor fed into the canister to a reasonable level even when the fuel temperature is high after the engine has just stopped operating. Similarly to the first embodiment previously described, the two-stage adjustments of the fuel tank pressure when the engine is operating and when the engine stops operating can be achieved by using only one pressure control valve of a simple structure.

In a case of an evaporated fuel purge system in which the pressure control valve 20 of the first embodiment is provided, the fuel tank pressure Pt is dependent on the negative pressure of the port 42 adjacent to the canister 36 when the engine is operating. However, when the vehicle is running under extraordinary atmospheric conditions or when the fuel tank is replenished with fuel of a type with high volatility, the fuel tank pressure is increased to an excessively high pressure during the engine operation and the negative pressure of the port 42 is not at a level enough for the pressure control valve 20 to correctly adjust the fuel tank pressure when the engine stops operating.

In the evaporated fuel purge system to which the second embodiment is applied, the fuel tank pressure Pt can be correctly adjusted irrespective of the level of the negative pressure at the port 42 when the engine is operating. As described above, the first pressure value P1 is determined depending on the mechanical properties of the spring 76 and the diaphragm 75. Therefore, it is possible for the second embodiment to correctly adjust the fuel tank pressure if various levels of negative pressure are produced at the port 42 when the engine is operating.

Next, a description will be given of a third embodiment of the fuel pressure control apparatus according to the present invention. In the first embodiment previously described, the first set pressure (P−Pc) at which the fuel tank pressure Pt is maintained during the engine operation is dependent on the negative pressure Pc of the port 42 which is located adjacent to the canister 36. If the negative pressure Pc at a portion adjacent to the canister during engine operation is very low due to deterioration of the active carbon in the canister or due to saturation of the active carbon in the canister, the first set pressure (P−Pc) set by the pressure adjusting part will be lower than the atmospheric pressure. At this time, the valving member cannot be pressed on the valve seat by the actuating member, because the first set pressure by the pressure adjusting part is a negative pressure. In order to eliminate the above mentioned problem, the third embodiment of the present invention is provided.

Figure 7:
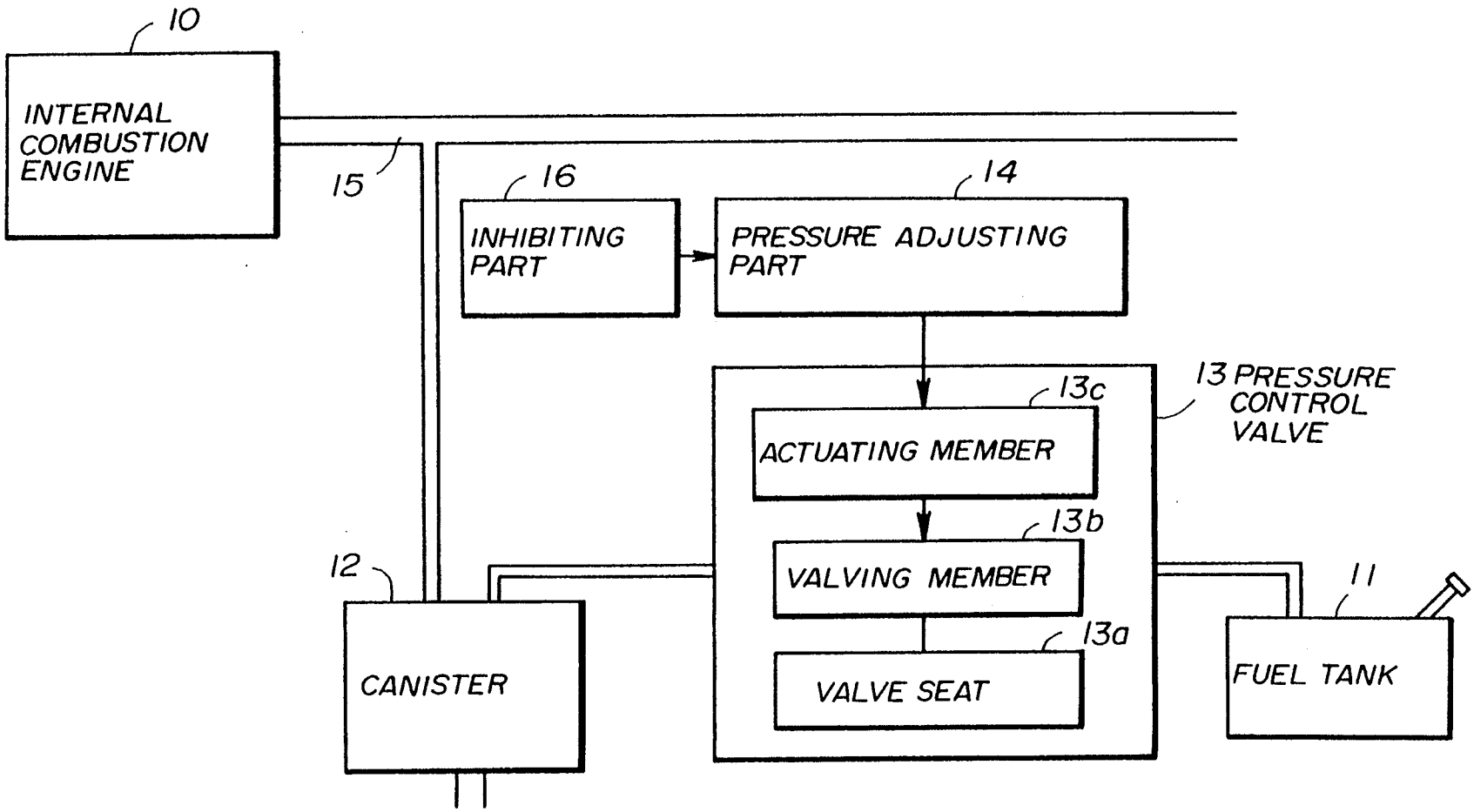
FIG. 7 is a block diagram showing a third embodiment of the fuel pressure control apparatus according to the present invention.

FIG. 7 shows the third embodiment of the fuel pressure control apparatus according to the present invention. In FIG. 7, the parts which are the same as the corresponding parts shown in FIG. 1 are designated by the same reference numerals, and a description thereof will be omitted. The fuel pressure control apparatus shown in FIG. 7 further includes an inhibiting part 16 for inhibiting the pressure adjusting part 14 from setting the first set pressure of the actuating member 13*c* (under which the valving member 13*b* is pressed on the valve seat 13*a*) to a pressure lower than a given pressure value. In the fuel pressure control apparatus shown in FIG. 7, the inhibiting part 16 allows that the first set pressure of the actuating member 13*c* set by the pressure adjusting part 14 is greatly influenced by a negative pressure at a portion adjacent to the canister 12 during the engine operation.

Figure 8:
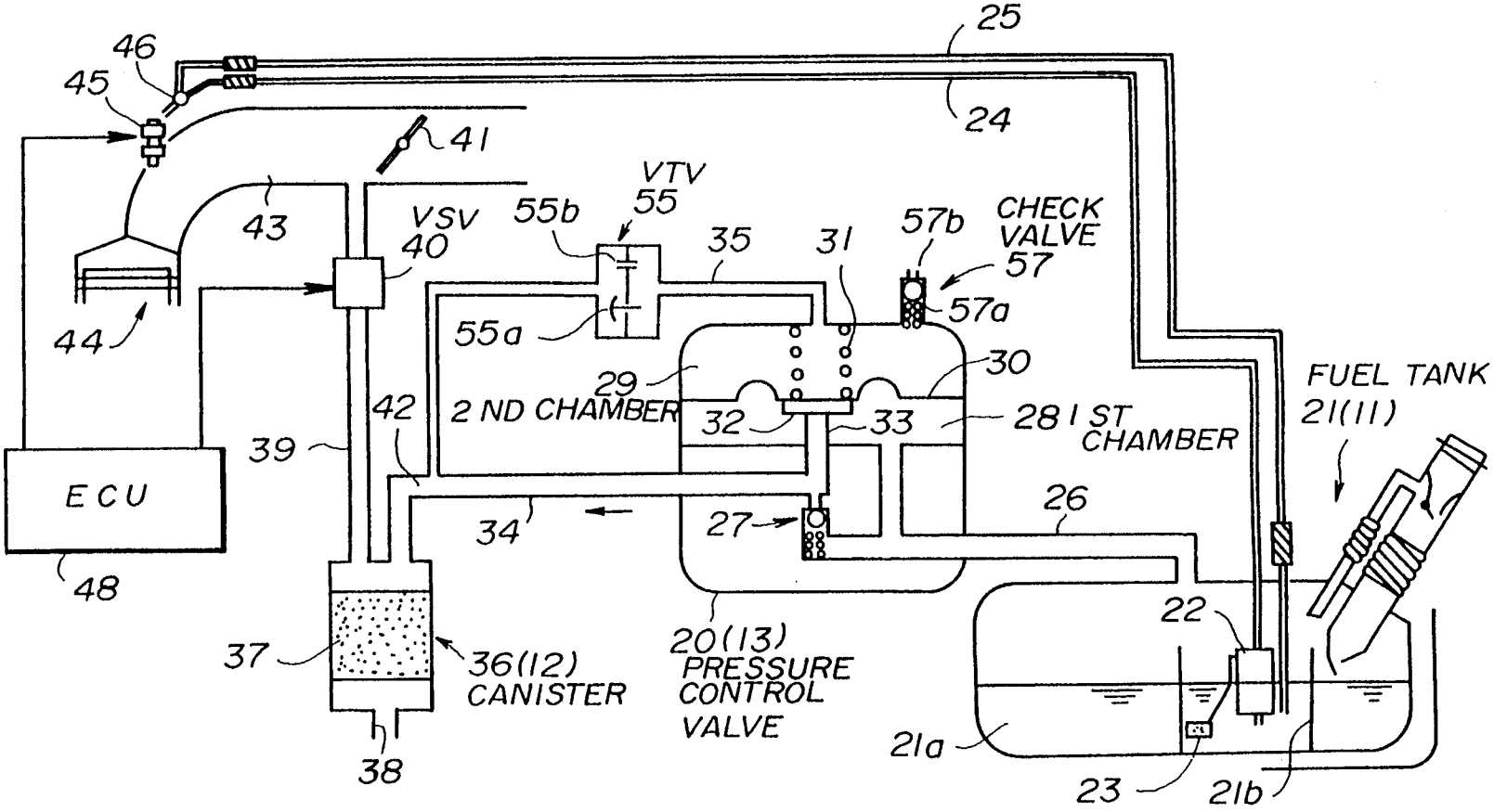
FIG. 8 is a diagram showing an evaporated fuel purge system to which the fuel pressure control apparatus shown in FIG. 7 is applied.

FIG. 8 shows an evaporated fuel purge system to which the third embodiment of the fuel pressure control apparatus shown in FIG. 7 is applied. In FIG. 8, the parts which are the same as the corresponding parts in FIGS. 2A and 2B are designated by the same reference numerals, and a description thereof will be omitted.

In the evaporated fuel purge system shown in FIG. 8, the pressure control valve 20 is formed with a check valve 57. This check valve 57 includes a spring 57*a*, a check ball 57*b*, and an opening leading to the atmosphere. The check ball 57*b* is upwardly pressed by the spring 57*a* under a third pressure P3 so as to close the opening at the check valve 57. This third pressure P3 is set by the mechanical property of the spring 57*a*. If the pressure of the second chamber 29 (negative pressure) is lowered to a pressure lower than the third pressure P3 set by the spring 57*a*, the check valve 57 is opened (the check ball 57*b* is lowered against the upward force of the spring 57*a*), so that the second chamber 29 is subjected to the atmospheric pressure via the opening at the check valve 57. Thus, immediately after the check valve 57 is opened, the check valve 57 is closed (the check ball 57*b* is raised by the spring 57*a*) because the pressure of the second chamber 29 is increased to a pressure higher than the third pressure P3 due to the atmospheric pressure. Thus, the check valve 57 serves to maintain the pressure of the second chamber 29 at a constant negative level equal to the third pressure P3 when the engine is operating. The inhibiting part 16 shown in FIG. 7 is realized by this check valve 57.

The second chamber 29 of the pressure control valve 20 communicates with the canister 36 through the negative pressure passage 35. The negative pressure passage 35 is connected to the second vapor passage 34 at the port 42. In the evaporated fuel purge system shown in FIG. 8, the vacuum transmitting valve (VTV) 55 is provided at an intermediate portion of the negative pressure passage 35 between the pressure control valve 20 and the canister 36.

The VTV 55 shown in FIG. 8 is made up of the check valve 55*a* and the orifice 55*b*. When the negative pressure of the port 42 is lower than the pressure of the second chamber 29 of the valve 20, both the check valve 55*a* and the orifice 55*b* are opened and the second chamber 29 is subjected to the negative pressure of the port 42 through the VTV 55. When the pressure of the port 42 is higher than the pressure of the second chamber 29, the check valve 55*a* is closed. The second chamber 29 of the valve 20 communicates with the port 42 through the orifice 55*b* only so as to prevent the internal pressure of the second chamber 29 from being increased to the atmospheric pressure.

Next, a description will be given, with reference to FIG. 9, of the operation of the third embodiment of the fuel pressure control apparatus according to the present invention. When the engine stops operating, the VSV 40 is switched off to close the purge passage 39 between the canister 36 and the intake passage 43. The pressure of the port 42 at this time is approximately equal to the atmospheric pressure. The second chamber 29 of the valve 20 is thus subjected to the atmospheric pressure because the second chamber 29 communicates with the canister 36 via the VTV 55 in the negative pressure passage 35 and the canister 36 communicates with the atmosphere via the air inlet opening 38.

Figure 9:
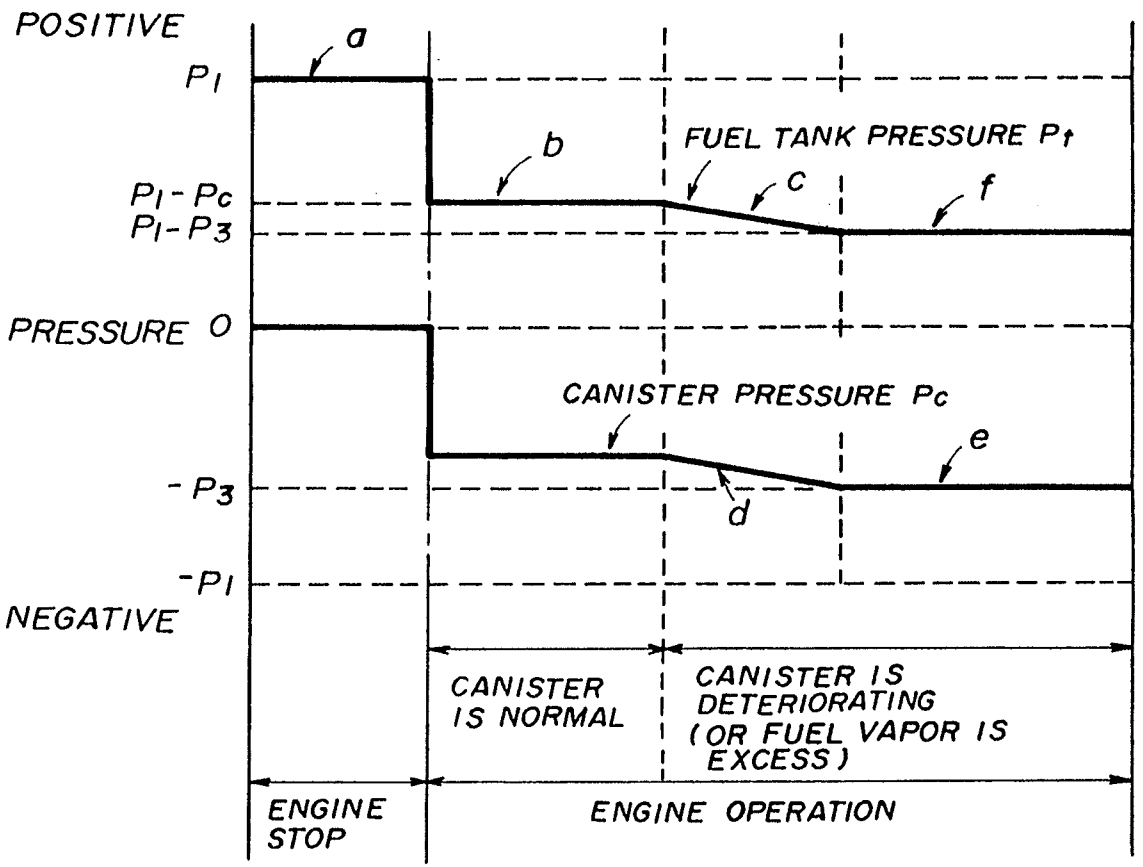
FIG. 9 is a timing chart for explaining the operation of the evaporated fuel purge system shown in FIG. 8.

As indicated by the arrow "a" in the timing chart in FIG. 9, the fuel tank pressure Pt (which pressure is equal to the pressure of the first chamber 28) is in equilibrium with a given pressure value P1 (which is positive or above the atmospheric pressure) when the engine stops operating. This pressure value P1 is set by the mechanical properties of the spring 31 and the diaphragm 30.

When the ignition switch IG is turned ON, the engine starts operating. The fuel pump 22 also starts operating to discharge fuel from the sub-tank 21*b* of the fuel tank 21 to the pressure regulator 46 via the fuel pipe 24. The fuel pressurized by the pressure regulator 46 is supplied to the fuel injector 45 so that the fuel is injected to the engine 44. The remainder of the fuel supplied by the fuel pump 22 to the fuel injector 45 is returned from the pressure regulator 46 to the fuel tank 21 via the fuel return pipe 25.

Fuel vapor, evaporated in the fuel tank 21, enters the first chamber 28 of the pressure control valve 20 via the first vapor passage 26. When the purge execution conditions are not satisfied during the engine operation, the pressure Pc of the port 42 is approximately equal to the atmospheric pressure because the port 41 communicates with the atmosphere through the air inlet opening 38 of the canister 36. The negative pressure passage 35 at this time is not subjected to a negative pressure, and the fuel tank pressure Pt (which pressure is equal to the pressure of the first chamber 28 of the valve 20) is in equilibrium with a given pressure value P1. This pressure value P1 (which is positive or above the atmospheric pressure) is set by the mechanical properties of the spring 31 and the diaphragm 30.

If the fuel tank pressure Pt is increased to a pressure higher than the pressure value P1, the valving member 32 is raised against the downward force of the spring 31 due to the increased pressure. The vapor inlet opening 33 is opened to make the first chamber 28 communicate with the canister 36 via the second vapor passage 34 so that the fuel vapor supplied from the fuel tank 21 is fed into the canister 36. The fuel vapor is absorbed in the active carbon 37 of the canister 36.

When the purge execution conditions are satisfied during the engine operation, the VSV 40 is switched on by the ECU 48, so that the fuel vapor stored in the canister 36 is fed into the intake passage 43 through the VSV 40 in the purge passage 39 due to a negative pressure produced in the intake passage 43 during the engine operation. External air enters the canister from the air inlet opening 38 due to the negative pressure of the intake passage 43, and the fuel vapor is desorbed from the active carbon 37 of the canister 36. The active carbon 37 is de-activated after the desorption of the fuel vapor, and it is placed in a ready condition for absorbing fuel vapor subsequently supplied from the fuel tank 21.

When the fuel vapor is fed from the canister 36 into the intake passage 43 through the VSV 40 during the engine operation, the port 42 adjacent to the canister 36 is subjected to a negative pressure Pc of the canister 36 (which pressure is proportional to the negative pressure of the intake passage 43. Thus, the second chamber 29 of the valve 20 is subjected to the negative pressure Pc of the canister 28 through the VTV 55 in the negative pressure passage 35, since the port 42 communicates with the second chamber 29 via the negative pressure passage 35.

As a result, as indicated by the arrow "b" in FIG. 9, the fuel tank pressure Pt (which is equal to the pressure of the first chamber 28) is controlled by the pressure control valve 20 so as to be in equilibrium with a pressure indicated by a pressure value (P1−Pc) (which is lower than the pressure value P1). This pressure value (P1−Pc) is positive during the engine operation since the first pressure value P1 set by the spring 31 is greater than the absolute value of the negative pressure Pc of the canister 36.

If the active carbon 37 of the canister 36 is subsequently deteriorating or an excessive amount of fuel vapor has been stored in the canister 36, the pressure loss of the canister 36 within the evaporated fuel purge system will be increased to a greater value. Due to the increased pressure loss of the canister 36, the negative pressure of the port 42 (which is equal to the pressure Pc of the canister 36) will be further lowered as indicated by the arrow "d" in FIG. 9. In accordance with the change in the canister pressure Pc, the fuel tank pressure Pt will also be lowered as indicated by the arrow "c" in FIG. 9.

If the negative pressure Pc of the canister 36 (which is equal to the pressure of the second chamber 29) is lowered, during the engine operation, to be lower than the third pressure P3 set by the spring 57*a*, the check valve 57 is opened so that the second chamber 29 is subjected to the atmospheric pressure via the opening at the check valve 57. However, immediately after the check valve 57 is opened, the check valve 57 is closed because the pressure of the second chamber 29 is increased to be higher than the third pressure P3 due to the atmospheric pressure. Then, the pressure of the second chamber 29 is to be in accordance with the pressure Pc of the canister 36.

In a manner described above, the check valve 57 is repeatedly opened and closed during the engine operation. Thus, the check valve 57 can prevent the pressure of the second chamber 29 from being lowered to be below the third pressure P3 set by the spring 57*a*. The pressure Pc of the canister 36 (which is equal to the pressure of the second chamber 29) is maintained by the check valve 57 at a constant level as indicated by the arrow "e" in FIG. 9. As a result, the fuel tank pressure Pt (which is equal to the pressure of the first chamber 28) is maintained at a constant pressure level (P1−P3) (>0) as indicated by the arrow "f" in FIG. 9. Therefore, since the negative pressure of the second chamber 29 is maintained to be higher than the third pressure P3, the valving member 32 is downwardly pressed by the spring 31 on the vapor inlet opening 33 so as to close the vapor passage between the fuel tank and the canister during the engine operation.

Accordingly, in the third embodiment described above, if the pressure loss of the canister 36 within the evaporated fuel purge system is high due to the deterioration or saturation of the active carbon of the canister is high, the fuel tank pressure Pt can be maintained at a positive pressure level by the pressure control valve 20. By the construction of the pressure control valve 20 described above, it is possible to prevent the fuel in the fuel tank from spilling to the canister when the vehicle is turning around, and it is also possible to prevent the fuel tank from being replenished with an excessive amount of fuel.

Next, a description will be given of a fourth embodiment of the fuel pressure control apparatus. The objective of the fourth embodiment will be described before this embodiment is described in detail.

In the evaporated fuel purge system wherein the fuel tank pressure is maintained at a high pressure level, it is likely that the fuel within the fuel tank will boil under reduced pressure. The fuel tank pressure is reduced from the high pressure level when a fuel filler neck of the fuel tank is opened. The boiling of fuel in the fuel tank under reduced pressure occurs especially when the fuel filler neck is opened after the engine idling condition is stopped. The fuel temperature is high after the engine idling condition is stopped. If the fuel boils, an increasing amount of fuel vapor evaporated in the fuel tank will escape from the fuel filler neck to the atmosphere.

In order to prevent the boiling of the fuel in the fuel tank under reduced pressure, a conventional fuel pressure control device has been proposed. In this device, a first pressure valve and a second pressure valve are arranged in series in a vapor passage between the fuel tank and the canister, the first pressure valve being opened under a relatively low pressure, and the second pressure valve being opened under a relatively high pressure. A control part of the above conventional device allows the first pressure valve to be opened when the engine is operating, such that the internal pressure of the fuel tank is maintained at the low pressure set by the second pressure valve, and allows the first pressure valve to be closed when the engine stops operating, such that the internal pressure of the fuel tank is maintained at the high pressure set by the first pressure valve. Therefore, the change in the fuel tank pressure between when the engine stops operating and when the engine is operating is relatively small.

In the conventional device described above, the fuel tank pressure is changed, when the ignition is turned on, from the high pressure to the low pressure. A large amount of fuel vapor evaporated in the fuel tank when the engine stops operating is abruptly fed into the canister when the engine starts operating. Usually, a certain amount of fuel supplied from the fuel tank is absorbed by the active carbon of the canister. Thus, if the large amount of fuel vapor is fed from the fuel tank into the canister when the engine starts operating, the canister cannot store all the fuel vapor supplied from the fuel tank, and it is likely that excessive fuel vapor will escape from the air inlet opening of the canister.

In order to eliminate the problem of the conventional device described above, the fourth embodiment of the fuel pressure control apparatus according to the present invention is provided. In this embodiment, the fuel tank pressure is changed from the high pressure level to the low pressure level when the feeding of fuel vapor fed from the canister into the intake passage of the engine through the purge control valve has started during the engine operation.

Figure 10:
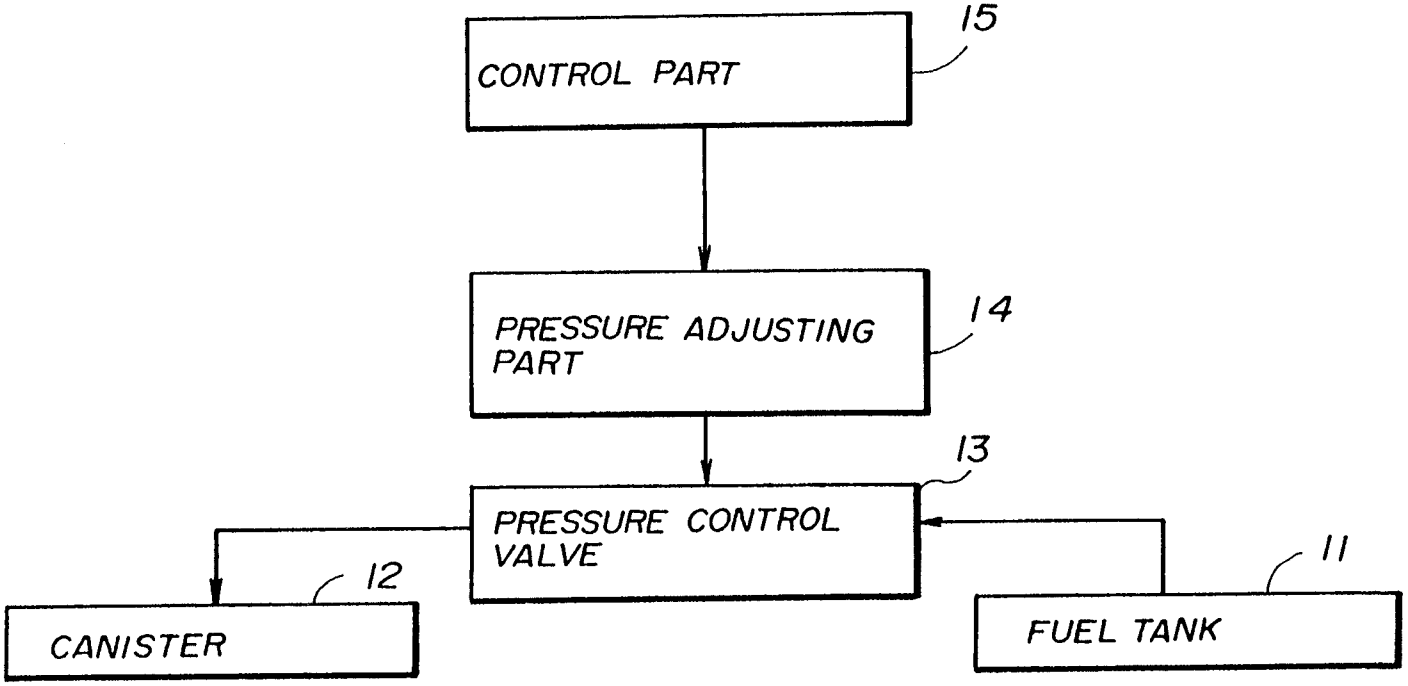
FIG. 10 is a block diagram showing a fourth embodiment of the fuel pressure control apparatus according to the present invention.

FIG. 10 shows the fourth embodiment of the fuel pressure control apparatus which is applied to an evaporated fuel purge system. The fuel pressure control apparatus shown in FIG. 10 includes a pressure control valve 13, a pressure adjusting part 14, and a control part 15.

In the fuel pressure control apparatus in FIG. 10, the pressure control valve 13 is provided at an intermediate portion in a passage between the fuel tank 11 and the canister 12. The pressure control valve 13 controls the flow of fuel vapor fed from the fuel tank 11 into the canister 12 so as to controls the internal pressure of the fuel tank 12. Fuel vapor evaporated in the fuel tank 11 is supplied to the pressure control valve 13 through the first vapor passage, and the fuel vapor supplied from the pressure control valve 13 is fed into the canister 12 through the second vapor passage. Thus, the fuel vapor is absorbed by the absorbent in the canister 12. The fuel vapor stored in the canister 12 is fed into the intake passage of the engine through the purge passage when the engine is operating under prescribed operating conditions.

The pressure control valve 13 shown in FIG. 10 includes a valve seat, a valving member, and an actuating member. The actuating member presses the valving member on the valve seat under a set pressure, such that the set pressure is in equilibrium with the internal pressure of the fuel tank.

The pressure adjusting part 14 adjusts the set pressure of the pressure control valve 13 to a first set pressure when the engine is operating. The first set pressure thus adjusted by the pressure adjusting part 14 allows the internal pressure of the fuel tank 11 to be in equilibrium with a pressure higher than the atmospheric pressure when the engine is operating. When the engine 10 stops operating, the pressure adjusting part 14 adjusts the set pressure of the pressure control part to a second set pressure. The second set pressure thus adjusted by the pressure adjusting part 14 allows the internal pressure of the fuel tank 11 to be in equilibrium with a pressure higher than the first set pressure when the engine stops operating.

When the feeding of fuel vapor from the canister 12 into the intake passage of the engine through the purge control valve has started, the control part 15 allows the pressure adjusting part 14 to adjust the set pressure of the pressure control valve 13 to a third set pressure. The third set pressure thus adjusted by the pressure adjusting part 14 allows the internal pressure of the fuel tank 11 to be, when the feeding of fuel vapor from the canister into the intake passage of the engine has started, in equilibrium with a pressure lower than the above mentioned pressure adjusted when the engine stops operating.

Figure 11:
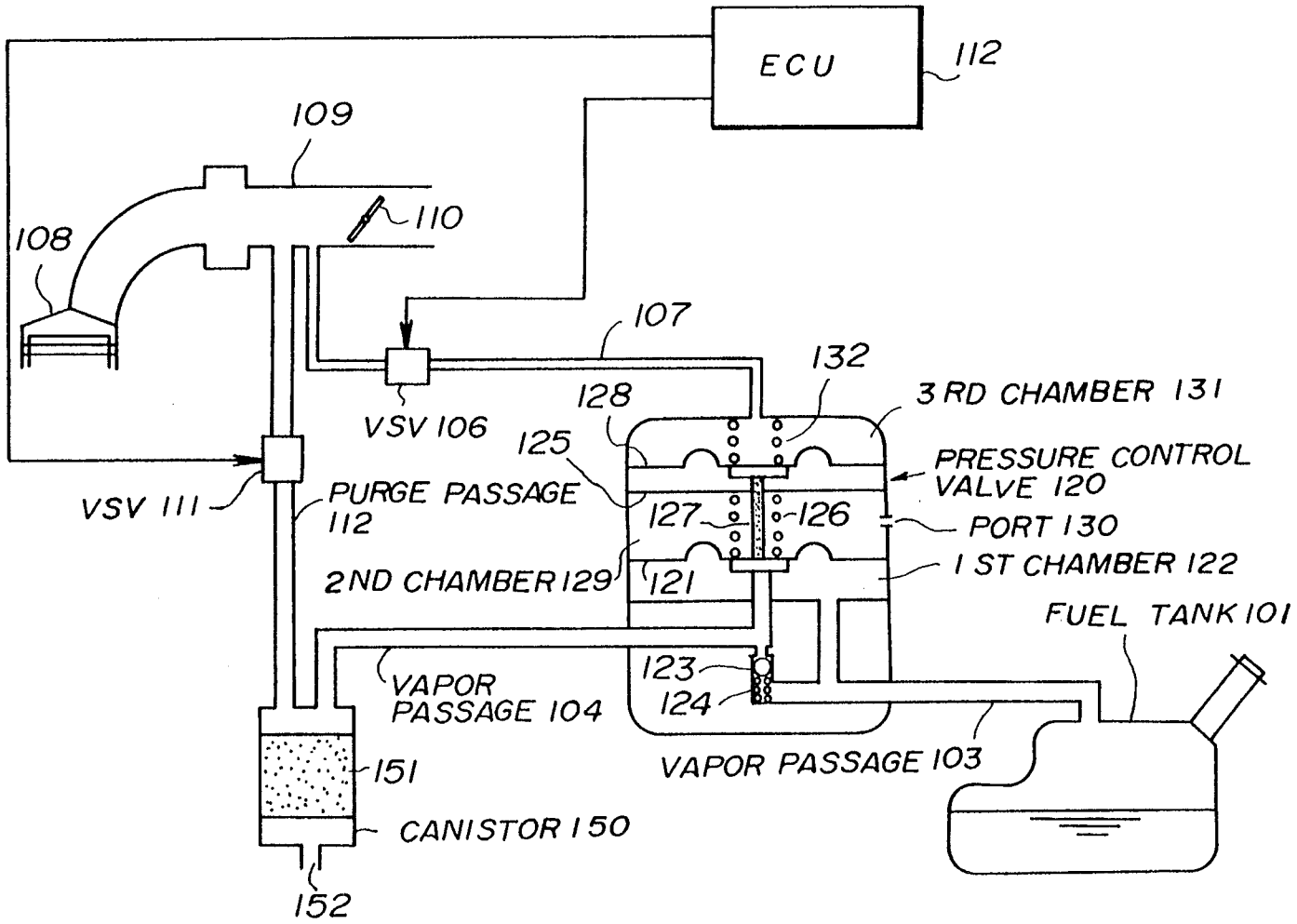
FIG. 11 is a diagram showing an evaporated fuel purge system to which the fourth embodiment of the fuel pressure control apparatus shown in FIG. 10 is applied.

FIG. 11 shows an evaporated fuel purge system to which the fourth embodiment shown in FIG. 10 is applied. In the evaporated fuel purge system shown in FIG. 11, a fuel tank 101 containing fuel therein is connected to a pressure control valve 120 via a first vapor passage 103. The pressure control valve 120 is connected to a canister 150 via a second vapor passage 104. The pressure control valve 120 is made up of a first chamber 122, a second chamber 129, and a third chamber 131. The first chamber 122 is separated from the second chamber 129 by a diaphragm 121. The second chamber 129 is separated from the third chamber 131 by a diaphragm 128.

The first vapor passage 122 has two end portions located within the pressure control valve 120. The fuel tank 101 communicates with the first chamber 122 of the valve 120 via one end portion of the first vapor passage 103. The other end portion of the first vapor passage 103 is connected to the second vapor passage 104 via a check valve. This check valve is made up of a check ball 123 and a spring 124 upwardly pressing the check ball 123 so as to close the end portion of the first vapor passage 103. If the fuel tank pressure is lowered to a negative pressure below the atmospheric pressure, the check ball 123 is lowered against the upward force of the spring 124, and the first vapor passage 103 communicates with the second vapor passage 104 such that the fuel vapor stored in the canister 150 is fed back to the fuel tank 101 due to the negative pressure of the fuel tank 101.

One end of the second vapor passage 104 is connected to the canister 150. The canister 150 contains an active carbon 151 for absorbing fuel vapor supplied from the fuel tank. The other end of the second vapor passage 104 is located within the first chamber 122 of the valve 120, and this second vapor passage end is closed by the diaphragm 121. If the diaphragm 121 moves upward so as to open the end of the second vapor passage 104, the first chamber 122 communicates with the canister 150 via the second vapor passage 104 so that the first chamber 122 is subjected to the internal pressure of the canister 150.

A retaining portion 125 is fixed to a wall portion of the second chamber 129. A first spring 126 is provided between the diaphragm 121 and the retaining portion 125, and the first spring 126 is retained by the retaining portion 125. The diaphragm 121 is downwardly pressed by the first spring 126. Thus, the fuel tank pressure Pt (which is equal to the pressure of the first chamber 122) is in equilibrium with a first set pressure (Ps1) set by the first spring 126 and the diaphragm 121.

The diaphragm 128 has a downwardly extending shaft 127, and the diaphragm 128 is provided at a portion above the retaining portion 125 in the second chamber 129. The bottom end of the shaft 127 normally comes in contact with the diaphragm 121. An air inlet hole 130 is formed in the wall portion of the second chamber 129, and the second chamber 129 is open to the atmosphere via the air inlet hole 130 so that the second chamber 129 is always under the atmospheric pressure. Thus, the diaphragm 128 can freely move up and down, together with the shaft 127, in accordance with the internal pressure of the third chamber 131. The movement of the diaphragm 128 does not influence the downward force of the first spring 126 by which the diaphragm 121 is downwardly pressed on the end portion of the second vapor passage 104 in the pressure control valve 120.

A second spring 132 is provided between the upper inside wall of the third chamber 131 and the diaphragm 128, and the diaphragm 128 is downwardly pressed by the second spring 132. When the diaphragm 128 is downwardly pressed by the second spring 132, the bottom end of the shaft 127 comes in contact with the diaphragm 121. If the third chamber 131 is not subjected to a negative pressure, the fuel tank pressure Pt is in equilibrium with a second set pressure (=(Ps1+Ps2)) which is equal to a set pressure (=Ps2) set by the second spring 132 and the diaphragm 128, being added to the first set pressure (=Ps1) set by the first spring 126 and the diaphragm 121.

The third chamber 131 of the valve 120 communicates with an intake passage 109 of an engine 108 through a negative pressure passage 107. The negative pressure passage 107 extending from the pressure control valve 120 is connected to the intake passage 109 at a portion downstream of a throttle valve 110 in the intake passage 109. A vacuum switching valve (VSV) 106 is provided at an intermediate portion of the negative pressure passage 107 for controlling the flow of air from the valve 120 to the intake passage 109 or vice versa. An electronic control unit (ECU) 112 is provided so as to control the switching of the VSV 111 provided in the purge passage 112 and to control the switching of the VSV 106 in the negative pressure passage 107.

If the VSV 106 is switched on by the ECU 112 so that the negative pressure passage 107 is opened by the VSV 106, when a negative pressure is produced in the intake passage 109 during the operation of the engine 108, the third chamber 131 of the valve 120 is subjected to the negative pressure of the intake passage 109. As the third chamber 131 is subjected to the negative pressure, the diaphragm 128 moves up against the downward force of the spring 132 due to such negative pressure. The bottom end of the shaft 127 is separated from the diaphragm 121. Therefore, the diaphragm 121 at this time is downwardly pressed on the second vapor passage end by the spring 126 only, so that the fuel tank pressure Pt is in equilibrium with the first set pressure Ps1 set by the spring 126 and the diaphragm 121. Conversely, if the VSV 106 is switched off by the ECU 112 so that the negative pressure passage 107 is closed by the VSV 106, the third chamber 131 is not subjected to the negative pressure. Thus, the fuel tank pressure Pt is in equilibrium with the second set pressure (Ps1+Ps2) set by the springs 126 and 132 and the diaphragms 121 and 128.

Accordingly, in the evaporated fuel purge system shown in FIG. 11, the fuel tank pressure Pt can be adjusted to be in equilibrium with either the first set pressure Ps1 (relatively low) or the second set pressure (Ps1+Ps2) (relatively high) by the switching of the VSV 106 performed the ECU 112.

In the evaporated fuel purge system shown in FIG. 11, the first chamber 122 of the valve 120 communicates with the internal space of the fuel tank 101 through the first vapor passage 103. If a large amount of fuel vapor is evaporated in the fuel tank 101, the fuel tank pressure Pt is increased to be higher than the set pressure set by the pressure control valve 120. When the fuel tank pressure Pt is higher than the set pressure set by the pressure control valve 120, the diaphragm 121 moves up against the downward force of the spring 126. Thus, the diaphragm 121 is separated from the second vapor passage end, and the fuel vapor within the first chamber 122 is fed into the canister 150 through the second vapor passage 104.

After the fuel vapor within the first chamber 122 is fed into the canister 150, the pressure of the first chamber 122 (which is equal to the fuel tank pressure Pt) is lowered to be in equilibrium with the set pressure set by the pressure control valve 120. The fuel tank pressure Pt is not lowered from the set pressure of the pressure control valve 120. The diaphragm 121 comes in contact with the second vapor passage end, and the opening between the first chamber 122 and the second vapor passage end is closed by the diaphragm 121 due to the downward force of the spring 126. Therefore, the fuel tank pressure Pt is maintained by the pressure control valve 120 at a level lower than the set pressure set by the spring and the diaphragm. It is possible for the pressure control valve 120 to prevent the fuel tank pressure Pt from being increased to an extremely high pressure at which the fuel tank 101 be damaged. It is possible for the pressure control valve 120 to regulate the amount of fuel vapor fed from the fuel tank 101 into the canister 150.

The canister 150 is provided at the bottom portion with an air inlet opening 152 leading to the atmosphere. The canister 150 communicates with the intake passage 109 of the engine 108 through the purge passage 112. At an intermediate portion of the purge passage 112, a vacuum switching valve (VSV) 111 is provided to control the flow of fuel vapor fed from the canister 150 into the intake passage 109. The purge passage 112 extending from the canister 150 is connected to the intake passage 109 at a portion downstream of the throttle valve 110 in the intake passage 109.

If the VSV 111 is switched on by the the ECU 112 to open the purge passage 112 when a negative pressure is produced in the intake passage 109 during the engine operation, the canister 150 is subjected to the negative pressure of the intake passage 109 through the purge passage 112. As the internal pressure of the canister 150 becomes negative, fuel vapor stored in the canister 150 is fed into the intake passage 109 through the purge passage 112 because external air enters the canister 150 via the air inlet opening 152 due to the negative pressure.

Figure 12B:
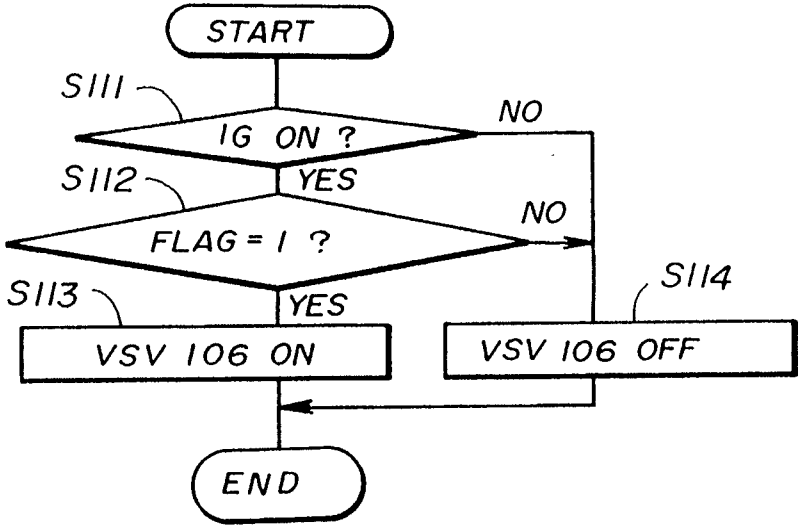
FIGS. 12A and 12B are flowcharts for explaining a purge control process for controlling a purge control valve, and a negative pressure control process for controlling a negative pressure control valve, which are performed by a control part of the apparatus in FIG. 10.
Figure 12A:
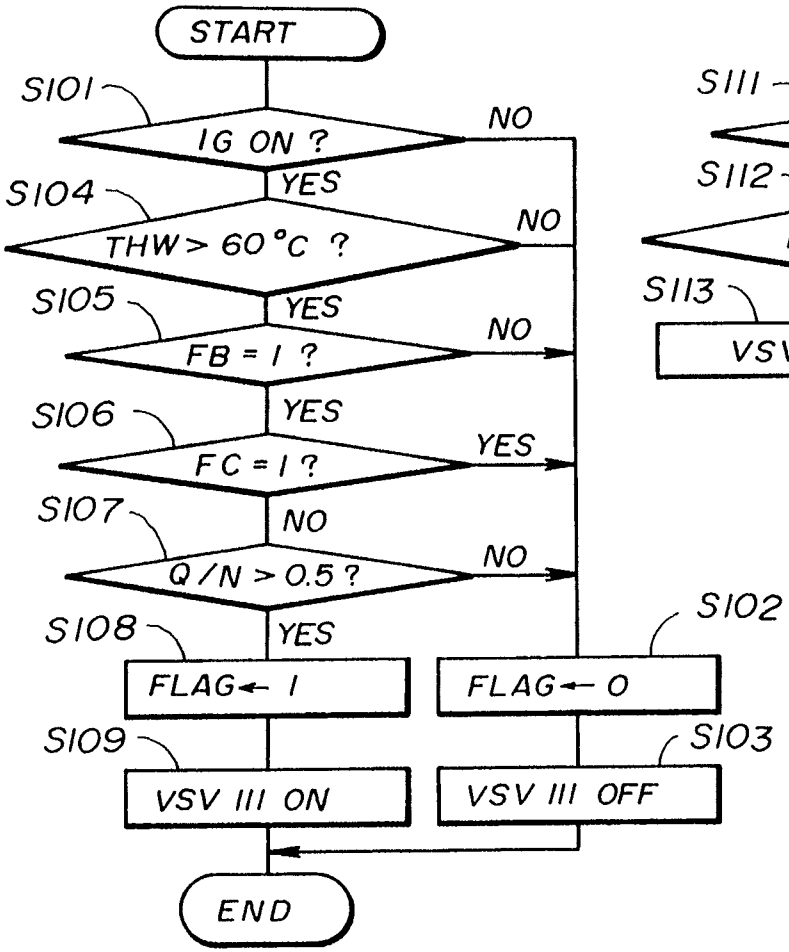

Next, a description will be given of the operation of the evaporated fuel purge system shown in FIG. 11, with reference to FIGS. 12A and 12B. FIG. 12A shows a purge control process for carrying out the switching of the VSV 111 in the purge passage 112 in FIG. 11. FIG. 12B shows a negative pressure control process for carrying out the switching of the VSV 106 in the negative pressure passage 107 in FIG. 11. Both the purge control process and the negative pressure control process are performed by the ECU 112 in FIG. 11.

When the purge control process shown in FIG. 12A starts, step S101 detects whether or not the ignition switch (IG) is turned on, so as to determine whether or not the engine 108 is operating. If the ignition switch IG is "off", it is determined that the engine 108 is not operating. As the purge execution conditions are not satisfied, steps S102 and S103 are performed. Step S102 resets a purge execution flag to zero (FLAG←0), which indicates that any of the purge execution conditions are not satisfied. Step S103 switches off the VSV 111 to close the purge passage 112 between the canister 150 and the intake passage 109. Then, the purge control process ends.

If a certain amount of fuel vapor is fed from the canister 150 into the intake passage 109 through the VSV 111, the total amount of fuel supplied to the engine is increased from the amount of fuel injected by a fuel injector to the engine. When the engine is operating under special operating conditions, if the total amount of fuel supplied to the engine is increased, the air-fuel ratio may deviate from a desired value and the exhaust emission performance may deteriorate. To avoid these problems, the feeding of fuel vapor from the canister into the intake passage of the engine through the VSV 111 is performed when all the purge execution conditions are satisfied. The purge execution conditions to be satisfied to start the feeding of fuel vapor into the intake passage are: (1) the engine idling condition is completed; (2) the air-fuel ratio feedback control process is being performed; (3) the engine load (=intake air amount per engine speed) is higher than a prescribed value; and (4) the engine is not operating under a fuel cut condition.

If the answer to step S101 is affirmative (IG is "on"), step S104 detects whether or not an engine cooling water temperature THW sensed by a sensor is higher than 60 deg. C. If THW>60 deg. C., it is determined that the engine idling condition is completed (the item (1) above). Then, step S105 is performed.

If the answer to step S104 is affirmative, step S105 detects whether or not an FB flag is equal to 1. This FB flag indicates whether the air-fuel ratio feedback control process is being performed. If the answer to step S105 is affirmative, it is determined that the air-fuel ratio feedback control process is being performed (the item (2) above). Then, step S106 is performed.

Step S106 detects whether or not an FC flag is equal to 1. This FC flag indicates whether the engine is operating under a fuel cut condition. If the answer to step S106 is negative (FC=0), it is determined that the engine is not operating under a fuel cut condition (the item (4) above). Then, step 107 is performed.

Step S107 detects whether or not the engine load Q/N (where Q is the intake air amount and N is the engine speed) is greater than 0.5. If the answer to step S107 is affirmative (Q/N>0.5), it is determined that the engine load is greater than the prescribed value (the item (3) above). Then, steps S108 and S109 are performed.

Therefore, when all the purge execution conditions (the items (1)–(4) above) are satisfied, steps S108 and S109 are performed. Step S108 sets the purge execution flag to one, which indicates that all the purge execution conditions are satisfied. Step S109 switches on the VSV 111 to open the purge passage 112 between the canister 150 and the intake passage 109. Then, the purge control process ends. The engine 108 at this time is operating, and the intake passage 109 is subjected to a negative pressure of the intake passage 109. Thus, fuel vapor stored in the canister 150 is fed into the intake passage 109 through the VSV 111 due to such negative passage.

If any of the purge execution conditions are not satisfied, steps S102–S103 described above are performed, and then the purge control process ends. This process is repeatedly performed by the ECU 112 until all the purge execution conditions are satisfied.

Next, the negative pressure control process shown in FIG. 12B will be described. When the negative pressure control process starts, step S111 detects whether or not the ignition switch IG is turned on, so as to determine whether or not the engine is operating.

If the answer to step S111 is affirmative (IG= ON), step S112 detects whether or not the purge execution flag (which has been set by the purge control process in FIG. 12A) is equal to 1. If the purge execution flag is equal to 1, it is determined that all the purge execution conditions are satisfied. Then, step S113 switches on the VSV 106 to open the negative pressure passage 107 between the pressure control valve 120 and the intake passage 109.

If the answer to step S111 is negative (IG=OFF), or, if the answer to step S112 is negative (the purge execution flag is equal to 0), step S114 is performed. Step S114 switches off the VSV 106 to close the negative pressure passage 107 to set the fuel tank pressure at the high pressure level. Then, the negative pressure control process ends.

Figures 13A, 13B, 13C:
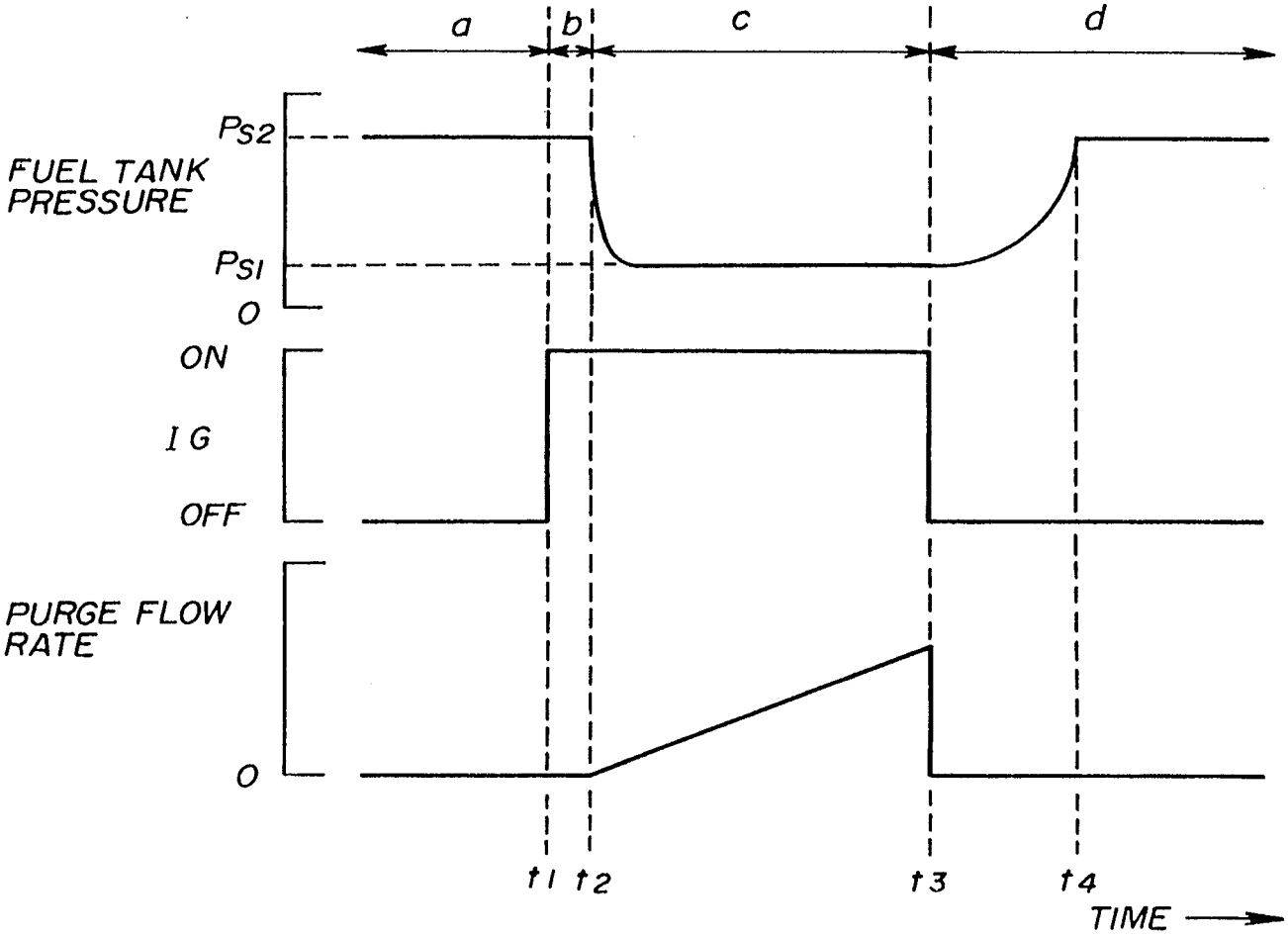

FIGS. 13A through 13C show the operation of the fuel pressure control apparatus shown in FIG. 10 while the purge control process and the negative pressure control process are performed. As in the timing chart in FIG. 13A, the fuel tank pressure is maintained at the high pressure level "Ps2" for time periods indicated by the arrows "a", "b" and "d". During these time periods "a", "b" and "d", the feeding of fuel vapor from the canister into the intake passage through the VSV 111 is not performed (the purge flow rate is equal to zero) as shown in FIG. 13C. As indicated in FIG. 13B, the engine stops operating during the time periods "a" and "d". Any of the purge execution conditions are not satisfied during the time period "b".

As shown in FIG. 13B, the ignition switch IG is turned on at the time point t1, and the engine is operating under an idling condition for a short time. At the time point t2, the purge execution conditions are detected as being satisfied. As shown in FIG. 13C, the feeding of fuel vapor from the canister into the intake passage through the VSV 111 starts at the time point t2, and the purge flow rate is increasing during the time period "c". At the same time (the time point t2) as the fuel vapor feeding has started, the set pressure of the pressure control valve is changed by the pressure adjusting part from the high pressure level "Ps2" to the low pressure level "Ps1". The fuel tank pressure is immediately reduced, and it is maintained at the low pressure level "Ps1" during the time period "c" as shown in FIG. 13C.

Figure 14:
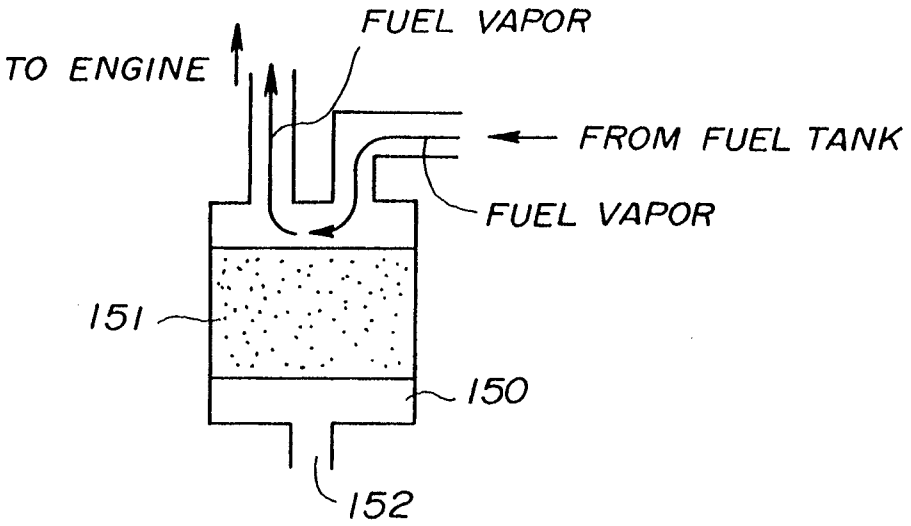
FIG. 14 is a diagram for explaining the effect of the fourth embodiment shown in FIG. 10.

FIG. 14 shows the flow of fuel vapor fed from the fuel tank 101 to the canister 150 when the fuel tank pressure changes from the high pressure level to the low pressure level. In the fourth embodiment described above, the fuel vapor is fed from the fuel tank 101 into the canister 150 after the feeding of fuel vapor stored in the canister 150 into the intake passage of the engine through the purge control valve 111 has started. Thus, as shown in FIG. 14, the fuel vapor supplied from the fuel tank at this time is not absorbed by the absorbent 151 of the canister 150, rather, it is fed into the intake passage of the engine. Accordingly, it is possible to prevent the fuel vapor stored in the canister from escaping to the atmosphere via the air inlet opening 152. The fuel vapor supplied from the fuel tank can be efficiently recovered.

Further, the present invention is not limited to the above described embodiments, and variations and modifications may be made without departing from the scope of the present invention.

What is claimed is

1. An apparatus for controlling an internal pressure of a fuel tank provided in an evaporated fuel purge system, said evaporated fuel purge system including the fuel tank containing fuel, a canister for storing fuel vapor supplied from the fuel tank, a purge control valve arranged in a purge passage between the canister and an intake passage of an engine, and a control part for opening the purge control valve when the engine is operating under prescribed operating conditions so that fuel vapor stored in the canister is fed into the intake passage through the purge passage, said apparatus comprising:

valve means for controlling the internal pressure of the fuel tank, said valve means including a valving member, a valve seat, and an actuating member for pressing the valving member on the valve seat with a set pressure, such that the internal pressure of the fuel tank is in equilibrium with the set pressure; and pressure adjusting means for adjusting the set pressure of the actuating member of the valve means to a first set pressure when the engine is operating, said first set pressure being higher than an atmospheric pressure, thus allowing the internal pressure of the fuel tank to be in equilibrium with said first set pressure by using a negative pressure of the intake passage, and for adjusting the set pressure to a second set pressure when the engine stops operating, said second pressure being higher than the first set pressure, thus allowing the internal pressure of the fuel tank to be increased when, the engine stops operating, to a pressure higher than the first set pressure wherein the pressure adjusting means comprises a negative pressure passage arranged between the canister and the valve means, and a vacuum transmitting valve provided at an intermediate portion of the negative pressure passage, one end of the negative pressure passage being connected to a chamber of the valve means and the other end thereof being connected to the canister, and wherein the negative pressure passage includes a bypass passage arranged so that the negative pressure passage communicates with the purge passage via the bypass passage.

2. An apparatus according to claim 1, wherein said valve means comprises a first chamber communicating with the fuel tank via a first vapor passage, and a second chamber in which said actuating member is provided, said first chamber and said second chamber being separated from each other by a diaphragm, said valving member being mounted on the diaphragm at an end of a second vapor passage communicating with the canister, and said second vapor passage end being formed at said valve seat such that the valving member is pressed on the second vapor passage end within the first chamber under the set pressure of the actuating member.

3. An apparatus according to claim 1, wherein said pressure adjusting means comprises a negative pressure passage arranged between the intake passage and the valve means, one end of said negative pressure passage being connected to a chamber of the valve means and the other end thereof being connected to the intake passage, such that said chamber of the valve means is subjected to a negative pressure of the intake passage via the negative pressure passage when the engine is operating.

4. An apparatus for controlling an internal pressure of a fuel tank provided in an evaporated fuel purge system, said evaporated fuel purge system including the fuel tank containing fuel, a canister for storing fuel vapor supplied from the fuel tank, a purge control valve arranged in a purge passage between the canister and an intake passage of an engine, and a control part for opening the purge control valve when the engine is operating under prescribed operating conditions so that fuel vapor stored in the canister is fed into the intake passage through the purge passage, said apparatus comprising:

valve means for controlling the internal pressure of the fuel tank, Said valve means including a valving member, a valve seat and an actuating member for pressing the valving member on the valve seat with a set pressure, such that the internal pressure of the fuel tank is in equilibrium with the set pressure wherein said valve means is made up of a first chamber communicating with the fuel tank via a first vapor passage, a second chamber in which a first actuating part is provided, and a third chamber in which a second actuating part is provided, said actuating member comprising said first actuating part and said second actuating part, wherein said first chamber and said second chamber are separated from each other by a diaphragm, said valving member being mounted on the diaphragm at an end of a second vapor passage communicating with the canister, and said second vapor passage end being formed at said valve seat such that the valving member is pressed on the second vapor passage end within the first chamber under the set pressure of the actuating member, and wherein said second chamber and said third chamber are separated from each other by a second diaphragm, a second valving member being mounted on said second diaphragm, said second valving member having a downwardly extending shaft and being provided within the second chamber such that a bottom end of said, shaft is engaged with said valving member when the engine stops operating; and pressure adjusting means for adjusting the set pressure of the actuating member of the valve means to a first set pressure when the engine is operating, said first set pressure being higher than an atmospheric pressure, thus allowing the internal pressure of the fuel tank to be in equilibrium with said first set pressure by using a negative pressure of the intake passage, and for adjusting the set pressure to a second set pressure when the engine stops operating., said second pressure being higher than the first set pressure, thus allowing the internal pressure of the fuel tank to be increased when, the engine stops operating, to a pressure higher than the first set pressure.

5. An apparatus according to claim 1, further comprising inhibiting means for preventing the first set pressure of the actuating member of the valve means, adjusted by said pressure adjusting means, from being lower than a given positive pressure when the engine is operating.

6. An apparatus according to claim 5, wherein said inhibiting means comprises a check valve which is arranged between a chamber of the valve means and the atmosphere, said check valve being opened when the chamber of the valve means is subjected to a pressure lower than the first set pressure of the actuating member due to a negative pressure of the intake passage, such that the chamber of the valve means is subjected to the atmospheric pressure.

7. An apparatus according to claim 5, wherein said valve means comprises a first chamber communicating with the fuel tank via a first vapor passage, and a second chamber in which said actuating member is provided, said first chamber and said second chamber being separated from each other by a diaphragm, said valving member being mounted on the diaphragm at an end of a second vapor passage communicating with the canister, and said second vapor passage end being formed at said valve seat such that the valving member is pressed on the second vapor passage end within the first chamber under the set pressure of the actuating member.

8. An apparatus according to claim 5, wherein said pressure adjusting means comprises a negative pressure passage arranged between the canister and the valve means, and a vacuum transmitting valve provided at an intermediate portion of said negative pressure passage, one end of the negative pressure passage being connected to a chamber of the valve means and the other end thereof being connected to the canister.

9. An apparatus for controlling an internal pressure of a fuel tank provided in an evaporated fuel purge system, said evaporated fuel purge system including the fuel tank containing fuel, a canister for storing fuel vapor supplied from the fuel tank, a purge control valve arranged in a purge passage between the canister and an intake passage of an engine, and a control part for opening the purge control valve when the engine is operating under prescribed operating conditions so that fuel vapor stored in the canister is fed into the intake passage through the purge passage due to a negative pressure of the intake passage, said apparatus comprising:

valve means arranged in a vapor passage between the fuel tank and the canister for controlling the internal pressure of the fuel tank, said valve means being opened when the internal pressure of the fuel tank is higher than a set pressure, so that the fuel tank communicates with the canister via the vapor passage;

pressure adjusting means for adjusting the set pressure of the valve means to a first set pressure when the engine is operating, said first set pressure being higher than an atmospheric pressure, and for adjusting the set pressure of the valve means to a second set pressure when the engine stops operating, said second set pressure being higher than the first set pressure; and control means for allowing said pressure adjusting means to adjust the set pressure of the valve means to the first set pressure after the feeding of fuel vapor from the canister into the intake passage through the purge control valve has started while the engine is operating.

10. An apparatus according to claim 9, wherein said valve means comprises a valving member, a valve seat, and an actuating member for pressing the valving member on the valve seat under the set pressure, such that the internal pressure of the fuel tank is in equilibrium with the set pressure.

11. An apparatus according to claim 9, wherein said pressure adjusting means comprises a negative pressure passage arranged between the valve means and the intake passage of the engine, and a negative pressure control valve provided at an intermediate portion of said negative pressure passage, one end of the negative pressure passage being connected to a chamber of the valve means and the other end thereof being connected to the intake passage.

12. An apparatus according to claim 9, wherein said control means switches on the purge control valve so as to open the purge passage when predetermined purge execution conditions are satisfied during engine operation, such that the feeding of fuel vapor from the canister into the intake passage through the purge passage has started.

13. An apparatus according to claim 11, wherein said control means switches on the negative pressure control valve so as to open the negative pressure passage after the purge control valve has been switched on so as to open the purge passage, thus allowing said pressure adjusting means to adjust the set pressure of the valve means to the first set pressure.

14. An apparatus according to claim 9, wherein said valve means is made up of a first chamber communicating with the fuel tank via a first vapor passage, a second chamber in which a first actuating member is provided, and a third chamber in which a second actuating member is provided, wherein said first chamber and said second chamber are separated from each other by a diaphragm, a valving member being mounted on the diaphragm at an end of a second vapor passage communicating with the canister, and said second vapor passage end being formed at a valve seat such that the valving member is pressed on the second vapor passage end within the first chamber under the set pressure of the valve means, wherein said second chamber and said third chamber are separated from each other by a second diaphragm, a second valving member being mounted on said second diaphragm, said second valving member having a downwardly extending shaft and being provided within the second chamber such that a bottom end of said shaft is engaged with said valving member when the engine stops operating.

* * * * *

UNITED STATES PATENT AND TRADEMARK OFFICE

CERTIFICATE OF CORRECTION

PATENT NO. : 5,359,978

DATED : November 1, 1994

INVENTOR(S) : Toru KIDOKORO, et al.

It is certified that error appears in the above-indentified patent and that said Letters Patent is hereby corrected as shown below:

On the title page, item [73], change "Aich," to --Aichi,--.

Column 3, line 54, change "through 13" to --through 13C--.

Column 10, line 46, change "high" to --higher--.

Column 15, line 48, change "controls" to --control--.

Column 18, line 8, after "performed" insert --by--.

Column 18, line 39, before "be" insert --would--.

Column 22, line 28, change "Said" to --said--.

Signed and Sealed this

Second Day of May, 1995

*Attest:*

*Attesting Officer*

BRUCE LEHMAN

*Commissioner of Patents and Trademarks*